US009969592B2

(12) United States Patent
Kowase et al.

(10) Patent No.: US 9,969,592 B2
(45) Date of Patent: May 15, 2018

(54) SHEET CONVEYING DEVICE, AND IMAGE FORMING APPARATUS AND IMAGE FORMING SYSTEM INCLUDING THE SAME

(71) Applicant: KONICA MINOLTA, INC., Chiyoda-ku, Tokyo (JP)

(72) Inventors: Kazuhiko Kowase, Toyokawa (JP); Michio Takahashi, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/092,302

(22) Filed: Apr. 6, 2016

(65) Prior Publication Data

US 2016/0318731 A1 Nov. 3, 2016

(30) Foreign Application Priority Data

May 1, 2015 (JP) ..... 2015-094139

(51) Int. Cl.
*B65H 7/06* (2006.01)
*B65H 29/60* (2006.01)
(Continued)

(52) U.S. Cl.
CPC ..... *B65H 43/04* (2013.01); *B65H 7/06* (2013.01); *B65H 29/12* (2013.01); *B65H 29/125* (2013.01);
(Continued)

(58) Field of Classification Search
CPC ..... G03G 2215/00552; G03G 15/5012; G03G 15/70; G03G 15/234; B65H 2301/33312;
(Continued)

(56) References Cited

U.S. PATENT DOCUMENTS 5,172,162 A * 12/1992 Taneda ..... B65H 29/60 270/58.14
8,417,176 B2 * 4/2013 Shoji ..... G03G 15/6579 271/184
(Continued)

FOREIGN PATENT DOCUMENTS

EP 0859289 A2 * 8/1998 ..... B65H 15/00
JP 09124208 A * 5/1997
(Continued)

OTHER PUBLICATIONS

Related U.S. Appl. No. 15/092,262; First named Inventor: Kazuhiko Kowase; Title: "Sheet Conveying Device, and Image Forming Apparatus and Image Forming Method System Including the Same"; Filed: Apr. 6, 2016.
(Continued)

*Primary Examiner* — Luis A Gonzalez
(74) *Attorney, Agent, or Firm* — Holtz, Holtz & Volek PC

(57) ABSTRACT

A sheet conveying device includes: a conveying unit configured to convey a sheet along a conveying path; a switching unit configured to switch a sheet conveying destination; a delivering unit configured to deliver the sheet on the delivery path toward a device at the sheet conveying destination; a reversing unit configured to first convey the sheet from the reversing port toward the outside of the casing to a position in which a part of the sheet protrudes and deliver the sheet from the position toward a circulation path while reversing the conveying direction of the sheet; a circulating unit configured to convey the sheet delivered toward the circulation path along the circulation path and return the sheet to the conveying path while the sheet is reversed; and a control unit configured to control the reversing unit when a jammed sheet is detected in the device at the sheet conveying destination.

17 Claims, 19 Drawing Sheets

(51) Int. Cl.

| | |
|---|---|
| ***B65H 85/00*** | (2006.01) |
| ***B65H 43/04*** | (2006.01) |
| ***B65H 29/12*** | (2006.01) |
| ***G03G 15/23*** | (2006.01) |
| ***B65H 31/24*** | (2006.01) |
| ***B65H 43/00*** | (2006.01) |
| ***G03G 15/00*** | (2006.01) |

(52) U.S. Cl.
CPC ..... *B65H 29/60* (2013.01); *B65H 31/24* (2013.01); *B65H 43/00* (2013.01); *B65H 85/00* (2013.01); *G03G 15/234* (2013.01); *G03G 15/5012* (2013.01); *G03G 15/70* (2013.01); *B65H 2301/33312* (2013.01); *B65H 2404/632* (2013.01); *B65H 2405/332* (2013.01); *B65H 2511/11* (2013.01); *B65H 2515/112* (2013.01); *B65H 2601/11* (2013.01); *B65H 2801/06* (2013.01); *B65H 2801/27* (2013.01)

(58) Field of Classification Search
CPC .. B65H 29/60; B65H 29/62; B65H 2511/528; B65H 2601/11; B65H 85/00
See application file for complete search history.

(56) References Cited

U.S. PATENT DOCUMENTS

| | | | | |
|---|---|---|---|---|
| 8,960,673 | B2 * | 2/2015 | Yoshida | B65H 29/125 271/225 |
| 9,096,398 | B2 * | 8/2015 | Nakagaki | B65H 7/125 |

FOREIGN PATENT DOCUMENTS

| | | | | |
|---|---|---|---|---|
| JP | 2004175482 | A | | 6/2004 |
| JP | 2008052125 | A | * | 3/2008 |
| JP | 2011145558 | A | * | 7/2011 |
| JP | 2014024614 | A | * | 2/2014 |
| JP | 2014119634 | A | | 6/2014 |

OTHER PUBLICATIONS

Japanese Office Action (and English translation thereof) dated May 30, 2017 issued in counterpart Japanese Application No. 2015-094139.

Chinese Office Action dated Jan. 22, 2018 issued in counterpart Chinese Application No. 201610268516.3.

* cited by examiner

SHEET CONVEYING DEVICE, AND IMAGE FORMING APPARATUS AND IMAGE FORMING SYSTEM INCLUDING THE SAME

The entire disclosure of Japanese Patent Application No. 2015-094139 filed on May 1, 2015 including description, claims, drawings, and abstract are incorporated herein by reference in its entirety.

BACKGROUND OF THE INVENTION

Field of the Invention

The present invention relates to a sheet conveying technique, and more particularly, to a purging technique.

Description of the Related Art

In general, a sheet conveying device mounted on an image forming apparatus such as a printer and a copying machine continuously conveys a plurality of sheets along one route. A printing process or the like is sequentially performed on these sheets at a high speed of several tens to several hundred or more of ppm.

When a jam (a paper jam) occurs at a certain position on the route, the image forming apparatus interrupts the process and causes a user to remove the jammed sheet. At this time, different sheets located before and after the jammed sheet are also forcedly stopped on the route. In order to resume the process, these sheets also need to be removed from the route in principle. However, the user feels troublesome whenever removing these sheets.

Among the sheet conveying devices of the related art, there is known a sheet conveying device devised for a user who feels troublesome in the sheet removing operation. Here, when the image forming apparatus interrupts the printing process or the like due to the jam or the like, all movable sheets are automatically discharged from the route. The sheet discharging operation which is performed by the sheet conveying device along with the process interrupting operation in the image forming apparatus will be referred to as a "purging operation". Generally, the sheet as a purging target is discharged to a dedicated tray provided separately from a normal sheet discharging tray.

Patent Literature 1: JP 2014-119634 A

Since some space is needed for the installation of a purging tray, the image forming apparatus having the purging function is limited to a comparatively large-sized image forming apparatus so far. However, there is a demand for providing the purging function even in a medium-sized image forming apparatus used in an office or the like in accordance with the recent trend of the high functionality of the image forming apparatus.

Meanwhile, when the purging tray is provided in the medium-sized image forming apparatus, it is difficult to meet a decrease in size and cost strongly required in the medium-sized image forming apparatus.

As the medium-sized image forming apparatus used for an office, for example, an image forming system having a duplex printing function illustrated in FIG. 20 is known.

An image forming system 950 illustrated in FIG. 20 includes an image forming apparatus 900, a relay device 910, and a post-processing device 920. The image forming apparatus 900 is a color copying machine having a duplex printing function. In the duplex printing mode, the image forming system 950 performs the following operation.

First, Y, M, C, and K colors of toner images formed by an imaging part 901 are transferred in multiple layers onto an intermediate transfer belt 906 traveling in the circumferential direction as indicated by the arrow. The color toner images which are transferred onto the intermediate transfer belt 906 in multiple layers are secondarily transferred onto a front surface of a sheet SHT fed from a cassette 902 at a secondary transfer position 907.

When the sheet SHT having the toner images secondarily transferred thereonto passes through a fixing part 903, the toner image is fixed onto the front surface of the sheet SHT and the sheet SHT is guided to a reversing part 904 through a branch point 960.

The reversing part 904 reversely rotates the reversing roller 941 immediately before the tail end of the sheet SHT reaches the reversing roller 941 while the leading end of the sheet SHT is caused to protrude outward from the reversing port 940 provided in the casing by the reversing roller 941. Accordingly, the conveying direction of the sheet SHT is switched back (reversed). The reversed sheet SHT is guided to a circulation part 905.

The sheet SHT which is guided to the circulation part 905 is conveyed along a circulation path 951 and is returned to the secondary transfer position 907. During the circulating and conveying operation, a toner image forming operation is performed by the imaging part 901. Thus, when the sheet SHT passes through the secondary transfer position 907, the toner image on the intermediate transfer belt 906 is secondarily transferred onto the rear surface of the sheet SHT.

When the sheet SHT having the toner image secondarily transferred thereonto passes through the fixing part 903, the toner image is fixed onto the rear surface of the sheet SHT and the sheet SHT is conveyed from the branch point 960 to the post-processing device 920 through the relay device 910. In the post-processing device 920, post-processing such as a staple-binding process is performed on the sheet SHT and the post-processed sheet SHT is discharged.

By a sheet reversing mechanism having such a reversing port 940, a space necessary for switching back the sheet SHT is saved. Thus, if the outside of the reversing port 940 can be also used as a purging destination, a purging function can be provided in the image forming apparatus 900 while the casing of the image forming apparatus 900 is maintained in a small size.

As the purging function, for example, a function is considered in which sheets SH1 to SH3 are forcedly discharged to the outside of the apparatus from the reversing port 940 when the sheets SH1 to SH3 are conveyed inside the image forming apparatus 900 in the case where a jam occurs in a sheet SH0 of the post-processing device 920.

Incidentally, when the sheets SH1 to SH3 are continuously conveyed and the purging operation is performed while the sheets are guided to the reversing port 940 in an original conveying order, for example, an order of SH1, SH2, and SH3, there is a case in which a new jam occurs due to the collision of the sheet SH1 conveyed toward the reversing port 940 during the reversing operation of the sheet SH3 in accordance with the positions of the sheets SH1 to SH3 on the conveying route in the event of the jam (as indicated by the dashed line). In this case, the effort of the user in the sheet removing operation is not reduced.

Such a problem can generally occur in a sheet conveying device having the above-described reversing mechanism in addition to the sheet conveying device provided in the image forming apparatus.

SUMMARY OF THE INVENTION

The present invention has been made in view of the above-described problems, and an object thereof is to provide a sheet conveying device including a reversing mechanism, conveying a sheet so that a part of the sheet protrudes outward from a reversing port and reversing the sheet, and having a purging function capable of reducing the effort of a user in a sheet removing operation as much as possible and to provide an image forming apparatus and an image forming system including the sheet conveying device.

To achieve the abovementioned object, according to an aspect, a sheet conveying device configured to convey a sheet toward a device at a sheet conveying destination in a normal operation state and to interrupt the sheet conveying operation toward the device at the sheet conveying destination when a jam is detected, the sheet conveying device reflecting one aspect of the present invention comprises: a conveying unit configured to convey a sheet along a conveying path; a switching unit configured to switch a sheet conveying destination from a branch point as a downstream end of the conveying path to any one of a delivery path extending toward the device at the sheet conveying destination and a reversing port formed as an opening of a casing of the sheet conveying device so that a space outside the casing is used as a space for reversing the sheet conveying direction; a delivering unit configured to deliver the sheet on the delivery path toward the device at the sheet conveying destination; a reversing unit configured to first convey the sheet from the reversing port toward the outside of the casing to a position in which a part of the sheet protrudes and deliver the sheet from the position toward a circulation path while reversing the conveying direction of the sheet; a circulating unit configured to convey the sheet delivered toward the circulation path along the circulation path and return the sheet to the conveying path while the sheet is reversed; and a control unit configured to control the reversing unit so that a first sheet is not reversed and is purged from the reversing port toward the outside of the casing if there is the first sheet supposed to be reversed by the reversing unit while being conveyed toward the reversing port when a jammed sheet is detected in the device at the sheet conveying destination.

Further, when there is a second sheet conveyed in any one of the conveying unit and the circulating unit separately from the first sheet at the jam detection time point, the control unit preferably controls the conveying unit, the reversing unit, the circulating unit, and the switching unit so that the sheet conveying destination of each second sheet is switched to the reversing port and each second sheet is purged from the reversing port toward the outside of the casing while not reversing the second sheet after the first sheet is purged.

Furthermore, if a predetermined condition is satisfied when the first sheet does not exist and a third sheet currently reversed by the reversing unit exists at the jam detection time point, the control unit preferably stops the reversing operation of the third sheet and re-reverses the third sheet in a direction toward the reversing port so that the third sheet is purged from the reversing port toward the outside of the casing.

Here, when there is a second sheet conveyed in at least one of the conveying unit and the circulating unit separately from the third sheet at the jam detection time point, the control unit preferably controls the conveying unit, the reversing unit, the circulating unit, and the switching unit so that the sheet conveying destination of each second sheet is switched to the reversing port and each second sheet is purged from the reversing port toward the outside of the casing while not reversing the second sheet after the third sheet is purged.

Here, on the assumption that the third sheet is re-reversed while the second sheet reaching the branch point at the first time is continuously conveyed after the jam detection time point, the predetermined condition is preferably a condition in which a leading end of the second sheet in the sheet conveying direction reaches the reversing unit after the reversing operation of the third sheet is completely switched to the re-reversing operation thereof.

Further, on the assumption that the third sheet is re-reversed while the second sheet reaching the branch point at the first time is continuously conveyed after the jam detection time point, the predetermined condition is preferably a condition in which the second sheet does not contact the third sheet.

Furthermore, the conveying speed of the third sheet during the re-reversing operation is preferably faster than the conveying speed of the third sheet during the reversing operation of the reversing unit.

Further, the circulating unit preferably includes a pair of rotating and conveying members conveying the sheet along the circulation path while nipping the sheet during the reversing operation, the reversing unit and the pair of rotating and conveying members are preferably driven by different driving mechanisms, and when a leading end of the third sheet in the sheet conveying direction during the reversing operation reaches the pair of rotating and conveying members at the jam detection time point, the control unit preferably stops each sheet conveying operation by prohibiting the purging operation regardless of whether the predetermined condition is satisfied.

Here, the driving mechanism of the rotating and conveying member is not preferably provided with a member stopping the transmission of a driving force to the rotating and conveying member at the jam detection time point so as to connect or disconnect a transmission route transmitting the driving force to the rotating and conveying member.

Further, the circulating unit preferably includes a pair of rotating and conveying members conveying the sheet along the circulation path while nipping the sheet during the reversing operation, the reversing unit and the pair of rotating and conveying members are preferably driven by different driving mechanisms, the driving mechanism of the rotating and conveying member is preferably provided with a member stopping the transmission of a driving force to the rotating and conveying member at the jam detection time point so as to connect or disconnect a transmission route transmitting the driving force to the rotating and conveying member, and if the predetermined condition is satisfied even when a leading end of the third sheet in the sheet conveying direction during the reversing operation reaches the pair of rotating and conveying member at the jam detection time point, the control unit preferably disconnects the transmission route and purges the third sheet.

Here, the circulating unit preferably includes a plurality of the pairs of rotating and conveying members provided in the circulation path with a gap therebetween, and on the assumption that the pair of rotating and conveying members closest to the sheet conveying direction of the sheet reversed from the reversing unit among the plurality of the pairs of rotating and conveying members is set as a first pair of rotating and conveying members and the pair of rotating and conveying members secondly closest to the sheet conveying direction of the reversed sheet is set as a second pair of rotating and conveying members, the control unit preferably purges the third sheet if the predetermined condition is satisfied when the leading end of the third sheet in the sheet conveying direction reaches the first pair of rotating and conveying members and does not reach the second pair of rotating and conveying members and the control unit preferably stops each sheet conveying operation by prohibiting the purging operation even if the predetermined condition is satisfied when the leading end of the third sheet in the sheet conveying direction reaches the second pair of rotating and conveying members.

Further, the control unit preferably stops each sheet conveying operation by prohibiting the purging operation regardless of whether the predetermined condition is satisfied when the third sheet is a predetermined type of sheet.

Here, the predetermined type of sheet is preferably a thick sheet having a basis weight larger than a predetermined value or any one of a high-quality sheet, a glossy sheet, a coated sheet, and a color sheet.

Further, if a condition is not satisfied in which a leading end of the second sheet in the sheet conveying direction reaches the branch point before the switching unit completely switches the sheet conveying destination from the delivery path to the reversing port on the assumption that the second sheet reaching the branch point at the first time is continuously conveyed, the control unit preferably prohibits the purging operation of the second sheet and retracts the second sheet to the delivery path while setting the sheet conveying destination as the delivery path, and if there is the second sheet reaching the branch point at the next time, the control unit preferably causes the switching unit to switch the sheet conveying destination from the delivery path to the reversing port and purges the second sheet.

Furthermore, the control unit preferably stops each sheet conveying operation by prohibiting the purging operation when the first sheet is a specific type of sheet.

Here, the specific type of sheet is preferably a thin sheet having a basis weight smaller than a predetermined value.

To achieve the abovementioned object, according to an aspect, an image forming apparatus configured to form an image on a sheet conveyed by a sheet conveying part, the image forming apparatus reflecting one aspect of the present invention comprises the sheet conveying device as the sheet conveying part.

To achieve the abovementioned object, according to an aspect, an image forming system reflecting one aspect of the present invention comprises: the image forming apparatus; and a post-processing device configured to perform predetermined post-processing on a sheet having an image formed thereon by the image forming apparatus, and a device at a sheet conveying destination of the sheet conveying device of the image forming apparatus is the post-processing device.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of a sheet conveying device, and an image forming apparatus and an image forming system including the sheet conveying device according to the present invention will be described with reference to the drawings. However, the scope of the invention is not limited to the illustrated examples.

[Appearance of Image Forming System]

Figure 1:
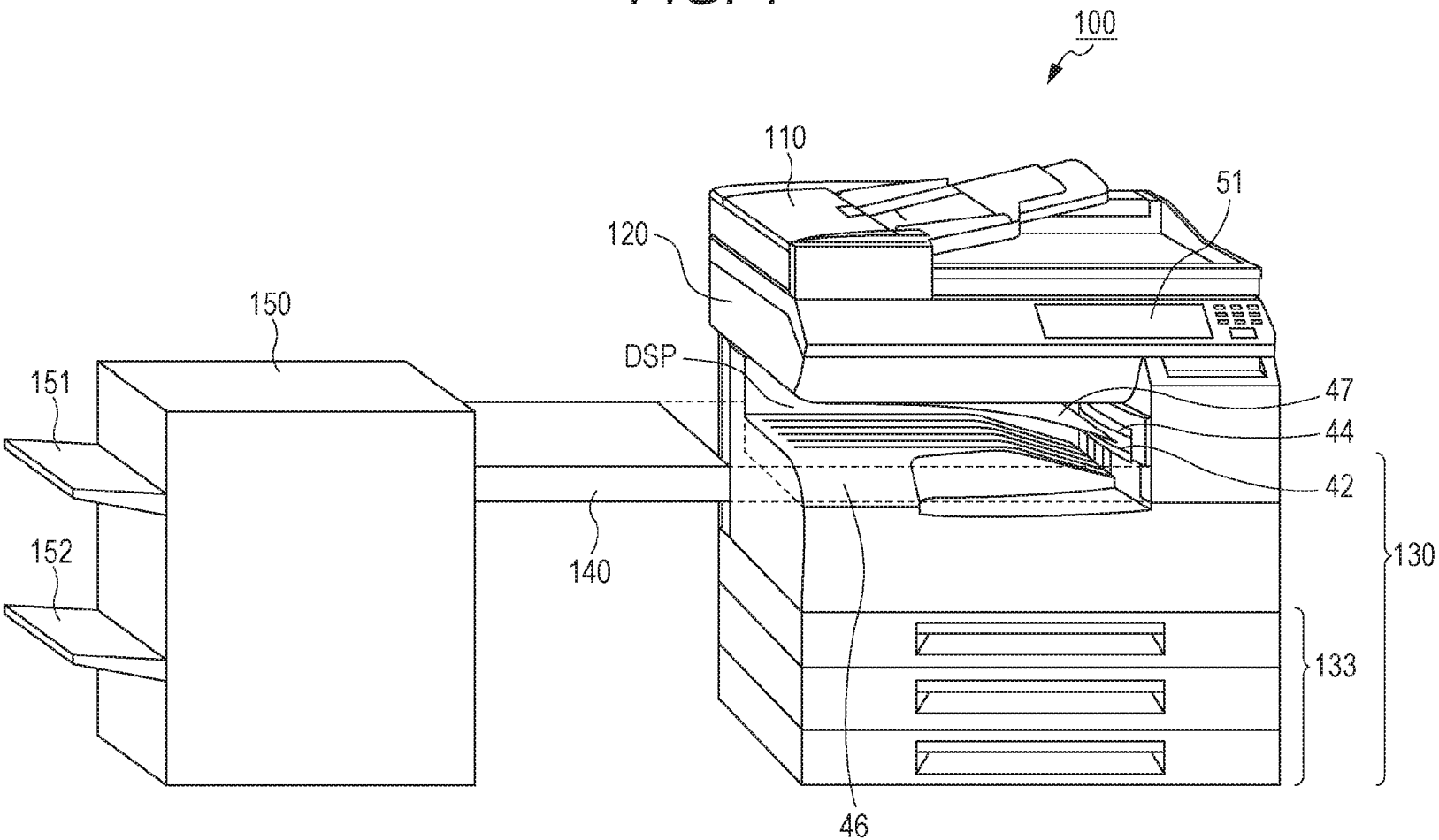
FIG. 1 is a perspective view illustrating the appearance of an image forming system.

FIG. 1 is a perspective view illustrating the appearance of an image forming system according to the embodiment of the present invention. The image forming system includes an MFP (Multi-Function Peripheral) 100, a relay unit 140, and a post-processing device 150.

The MFP 100 has the functions of a scanner, a color copying machine, and a color laser printer. As illustrated in FIG. 1, an ADF (Auto Document Feeder) 110 is attached to an upper surface of a casing of the MFP 100 so as to be openable and closable. A scanner 120 is built in the upper part of the casing located directly below the ADF 110, and a printer 130 is built in the lower part of the casing. A sheet feeding cassette 133 is attached to the bottom part of the printer 130 so as to be drawable.

The MFP 100 is of a sheet ejection type. That is, a sheet discharging tray 46 is separably installed in a gap DSP between the scanner 120 and the printer 130, and receives the sheet discharged from a sheet discharging port 42 at the back side of the gap DSP. At the gap DSP, a reversing tray 47 is provided on the sheet discharging tray 46. In a duplex printing mode, a sheet having an image printed on a front surface (a first surface) is switched back (reversed) on the reversing tray 47. That is, the sheet is first conveyed from a reversing port 44 opened above the sheet discharging port 42 to the upward protruding position of the reversing tray 47 and then is drawn into the reversing port 44 again while the conveying direction is reversed.

The relay unit 140 is assembled to a casing part of the MFP 100 instead of the sheet discharging tray 46. The relay unit 140 receives the sheet from the sheet discharging port 42 and relays the sheet to a post-processing device 150.

The post-processing device 150 performs post-processing on a sheet bundle received from the sheet discharging port 42 through the relay unit 140 in response to the instruction from the MFP 100. The post-processing includes, for example, a process of evenly arranging the sheet bundle and a process of stapling the sheet bundle.

As illustrated in FIG. 1, the post-processing device 150 includes two sheet discharging trays 151 and 152. The upper tray 151 has the sheets stacked thereon in a state where the sheets are delivered from the sheet discharging port 42. The lower tray 152 has the sheets stacked thereon in a state where the sheet bundle is evenly arranged or stapled.

[Inner Structure of Image Forming System]

Figure 2:
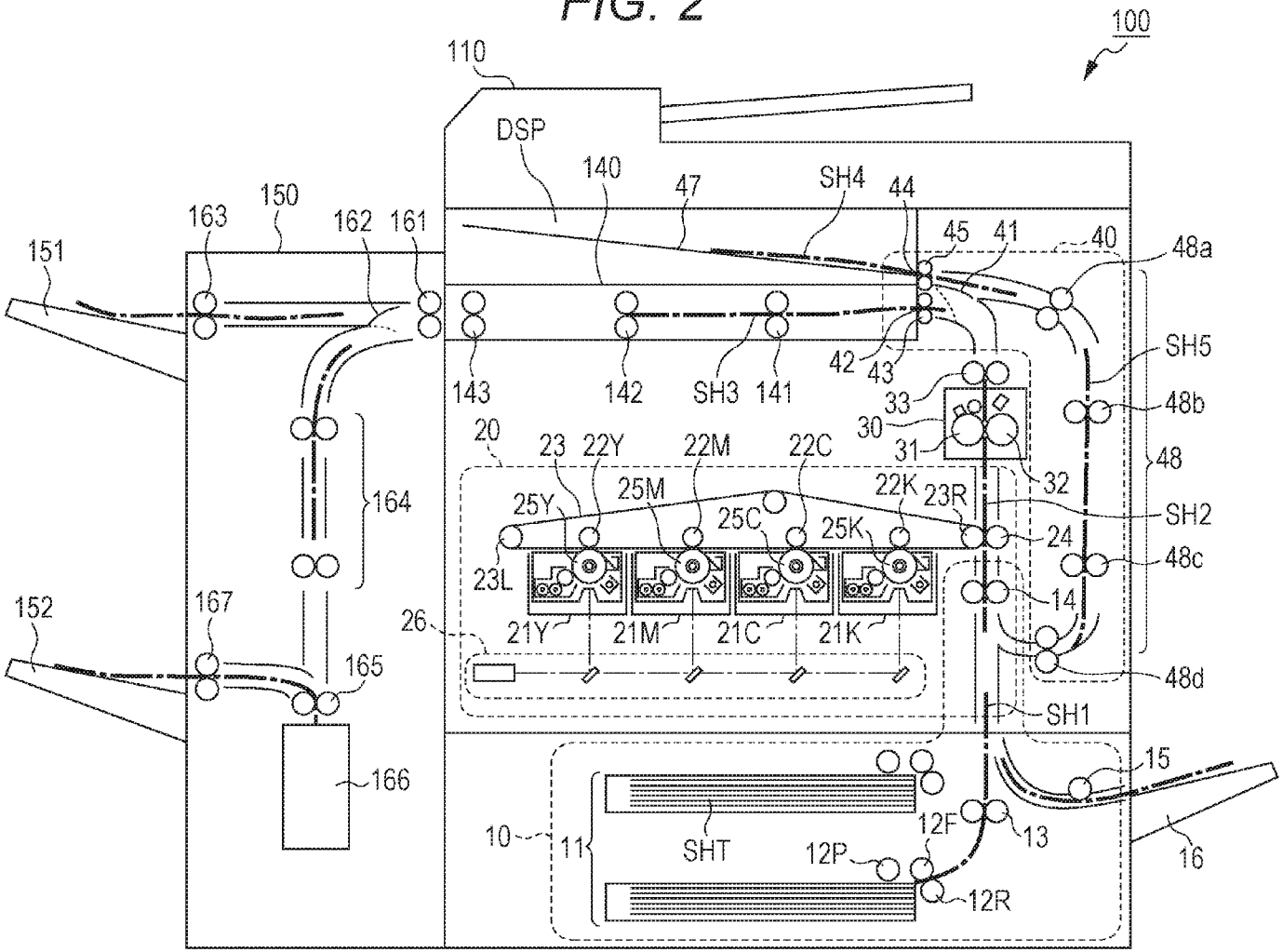
FIG. 2 is a front view schematically illustrating the inner structure of the image forming system.

FIG. 2 is a front view schematically illustrating the inner structures of the systems 100, 140, and 150 illustrated in FIG. 1. In FIG. 2, these inner components are depicted as if the casing is transparent. As illustrated in FIG. 2, the printer 130 includes a feeding part 10, an imaging part 20, a fixing part 30, and a delivering part 40. An image forming unit of the MFP 100 is realized by the combination of these components and a toner image is formed on the sheet based on image data.

The feeding part 10 feeds a sheet SH1 one by one to the imaging part 20 from a sheet bundle SHT stacked on a sheet feeding cassette 11 or a hand insertion tray 16 by the use of feeding roller groups 12P, 12R, 12F, 13, 14, and 15.

An example of the size of the sheet SHT received in the sheet feeding cassette 11 and the hand insertion tray 16 includes A3, A4, A5, or B4. Further, the sheet feeding cassette 11 is able to receive a normal sheet therein and the hand insertion tray 16 is able to receive, for example, a thin sheet in addition to the normal sheet. As the normal sheet, a sheet of which the basis weight is within a predetermined range, for example, 60 to 100 g/m$^2$ can be used. Then, as the thin sheet, a sheet of which the basis weight is smaller than a predetermined value, for example, 60 g/m$^2$ can be used.

The imaging part 20 forms a toner image on a sheet SH2 fed from the feeding part 10. Specifically, four imaging units 21Y, 21M, 21C, and 21K respectively first expose the surfaces of photosensitive drums 25Y, 25M, 25C, and 25K according to a pattern based on image data by using a laser beam emitted from an exposure part 26 and form electrostatic latent images on the surfaces thereof.

Next, the imaging units 21Y, 21M, 21C, and 21K develop the electrostatic latent images by the toner of yellow (Y), magenta (M), cyan (C), and black (K). The four color toner images are sequentially transferred onto the same position on the surface of an intermediate transfer belt 23 in a superimposed state from the surfaces of the photosensitive drums 25Y, 25M, 25C, and 25K by the electric field formed between each of the primary transfer rollers 22Y, 22M, 22C, and 22K and each of the photosensitive drums 25Y, 25M, 25C, and 25K. In this way, one color toner image is formed at the position.

The color toner image passes through a nip between the intermediate transfer belt 23 and the secondary transfer roller 24 along with the sheet SH2 fed from the feeding part 10 so that the color toner image is transferred onto the front surface of the sheet SH2 by the electric field formed between the intermediate transfer belt 23 and the secondary transfer roller 24. Subsequently, the secondary transfer roller 24 delivers the sheet SH2 toward the fixing part 30.

The fixing part 30 heat-fixes the toner image onto the sheet SH2 delivered from the imaging part 20. Specifically, when the sheet SH2 passes through a nip between a fixing roller 31 and a pressing roller 32, the fixing roller 31 applies heat of a heater provided therein to the front surface of the sheet SH2 and the pressing roller 32 presses the heating portion of the sheet SH2 against the fixing roller 31. Due to the heat of the fixing roller 31 and the pressure of the pressing roller 32, the toner image is fixed onto the front surface of the sheet SH2. Subsequently, a front sheet discharging roller 33 delivers the sheet SH2 toward the delivering part 40.

The delivering part 40 delivers the sheet SH2 delivered from the front sheet discharging roller 33 toward the relay unit 140 or reverses the sheet SH2 by the reversing tray 47. As illustrated in FIG. 2, the delivering part 40 includes a switching claw 41, the sheet discharging port 42, a sheet discharging roller 43, the reversing port 44, a reversing roller 45, and a circulation path 48. As for the rollers including the sheet discharging roller 43, a pair of rotation members rotates while the sheet is nipped therebetween so that the sheet is conveyed by a rotation force, but in the description below, the pair of rollers will be simply referred to as the roller.

The switching claw 41 is a claw-shaped or plate-shaped member of which a base end is rotatably fixed between the sheet discharging port 42 and the reversing port 44 and moves a front end thereof upward and downward while swinging about the base end. When the sheet delivered by the front sheet discharging roller 33 is delivered toward the relay unit 140, the switching claw 41 moves the front end upward so as to form a path (hereinafter, referred to as a "delivery path") toward the sheet discharging port 42. Then, when the sheet is reversed by the reversing port 44, the switching claw 41 moves the front end downward so as to form a path (hereinafter, referred to as a "reversing path") toward the reversing port 44. Each of the sheet discharging port 42 and the reversing port 44 is formed as a thin and elongated slit which is opened in the horizontal direction in the casing of the MFP 100 facing the gap DSP. The reversing port 44 corresponds to an opening of the casing so that an external space of the casing of the MFP 100 is used as a space for reversing the sheet conveying direction.

The sheet discharging roller 43 is disposed at the inside of the sheet discharging port 42 and rotates so as to deliver a sheet SH3 moved along the switching claw 41 from the sheet discharging port 42 toward the relay unit 140 by the peripheral surface. The reversing roller 45 is disposed at the inside of the reversing port 44 and is rotatable in both the normal and reverse rotation directions.

The reversing roller 45 first delivers a sheet SH4 moved along the switching claw 41 by the peripheral surface while rotating in the normal rotation direction from the reversing port 44 so that the sheet SH4 is placed on the reversing tray 47. The reversing roller 45 rotates reversely immediately before the tail end of the sheet SH4 passes therethrough so that the sheet SH4 is drawn from the reversing tray 47 into the reversing port 44, that is, the sheet SH4 is fed toward the circulation path 48 while the conveying direction is reversed.

In the circulation path 48, conveying rollers 48*a* to 48*d* return a sheet SH5 delivered by the reversing roller 45 toward the conveying route inside the feeding part 10 while the sheet is reversed. Here, the rotation direction in which each of the conveying rollers 48*a* to 48*d* conveys the sheet SH5 will be referred to as the normal rotation direction.

Subsequently, the feeding part 10 feeds the sheet SH5 to the imaging part 20 again and the imaging part 20 forms a toner image on a rear surface (a second surface) of the sheet SH5. The fixing part 30 performs a heat treatment on the sheet SH5 again and the delivering part 40 delivers the sheet SH5 toward the relay unit 140 at this time.

The relay unit 140 relays the sheet delivered from the sheet discharging port 42 toward the post-processing device 150 by the use of conveying roller groups 141, 142, and 143.

The post-processing device 150 includes an entrance conveying roller 161, a branch claw 162, an upper sheet discharging roller 163, a conveying roller group 164, a reversing roller 165, a post-processing part 166, and a lower sheet discharging roller 167 in addition to the sheet discharging trays 151 and 152.

The entrance conveying roller 161 receives a sheet from the relay unit 140 and draws the sheet into the casing. The branch claw 162 is a claw-shaped or plate-shaped member of which a base end is rotatably fixed and moves a front end thereof upward and downward while swinging about the base end. When the sheet drawn by the entrance conveying roller 161 is delivered toward the upper sheet discharging roller 163, the branch claw 162 moves the front end downward so as to form a path toward the upper sheet discharging roller 163. Meanwhile, when the sheet is delivered toward the post-processing part 166, the branch claw moves the front end upward so as to form a path toward the conveying roller group 164.

The upper sheet discharging roller 163 is disposed near the base end of the upper sheet discharging tray 151 and discharges the sheet moved from the entrance conveying roller 161 along the branch claw 162 toward the upper sheet discharging tray 151. The conveying roller group 164 conveys the sheet moved from the entrance conveying roller 161 along the branch claw 162 to the reversing roller 165 in a direction toward the post-processing part 166.

The reversing roller 165 is disposed at the entrance of the post-processing part 166 and is rotatable in both the normal and reverse rotation directions. The reversing roller 165 first feeds the sheet delivered from the conveying roller group 164 toward the post-processing part 166 by the peripheral surface while rotating in the normal rotation direction. Next, the reversing roller 165 draws the sheet bundle subjected to the post-processing by the peripheral surface from the post-processing part 166 while rotating in the reverse rotation direction.

The post-processing part 166 performs post-processing including an arranging process and a stapling process on a bundle as a predetermined number of sheets fed from the reversing roller 165. The lower sheet discharging roller 167 is disposed near the base end of the lower sheet discharging tray 152 and discharges the sheet bundle drawn from the post-processing part 166 by the reversing roller 165 toward the lower sheet discharging tray 152.

[Sheet Conveying Part]

As illustrated in FIG. 2, in the MFP 100, a part of the imaging part 20 and the fixing part 30 including a driving roller 23R of the intermediate transfer belt 23, the secondary transfer roller 24, the fixing roller 31, the pressing roller 32, the front sheet discharging roller 33, and the like serve as a sheet conveying part other than the feeding part 10 and the delivering part 40.

Figure 3:
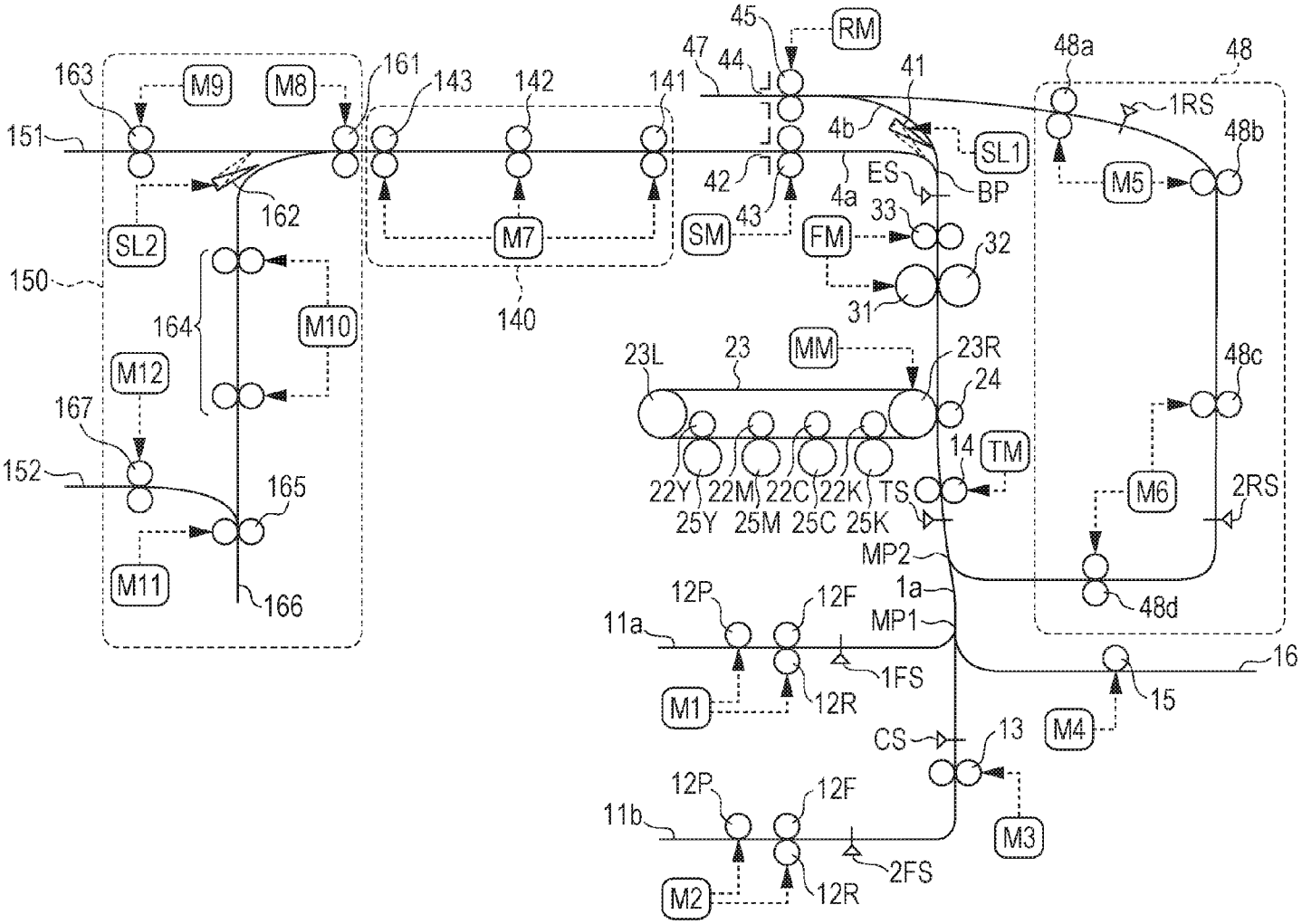
FIG. 3 is a schematic diagram illustrating a sheet conveying route which is formed by a conveying part of the image forming system.

FIG. 3 is a schematic diagram illustrating a sheet conveying route formed by the sheet conveying part.

As illustrated in FIG. 3, the route is formed as below. First, three sheet feeding routes extending from the sheet feeding cassettes 11*a* and 11*b* and the hand insertion tray 16 are combined into one route (hereinafter, referred to as a "conveying path") 1*a* at a first merging point MP1. The conveying path 1*a* passes through the imaging part 20 and the fixing part 30 and is divided into two routes, that is, a delivery path 4*a* and a reversing path 4*b* at a branch point BP facing the switching claw 41 of the delivering part 40.

The delivery path 4*a* is connected to the conveying route inside the relay unit 140 through the sheet discharging port 42, and the reversing path 4*b* is connected to the circulation path 48 by the reversing port 44. The circulation path 48 is connected to the conveying path 1*a* at a second merging point MP2 positioned near a timing roller 14.

Referring to FIG. 3 again, a plurality of optical sensors 1FS, 2FS, CS, TS, ES, 1RS, and 2RS is provided on these conveying routes in addition to the roller group 12P and the like illustrated in FIG. 2. The optical sensor 1FS and the like detect the sheet passing through the installation positions.

Specifically, each optical sensor includes a light emitting part and a light receiving part. The light emitting part emits a predetermined wavelength of light such as an infrared ray and the light receiving part detects the light of the wavelength. While one sheet passes through the installation position of each optical sensor, the sheet interrupts the light emitted from the light emitting part at the front side of the light receiving part or reflects the light toward the light receiving part. Since the output of the light receiving part changes in response to the interruption or the reflection of the emitted light, the sheet passing through the installation position of each optical sensor is detected. The detection result is transmitted from the feeding part 10, the delivering part 40, and the like to a main control unit 60 to be described later (see FIG. 5). In response to the detection result, the main control unit 60 determines whether the sheet conveying operation is normally performed without any jam or the sheet conveying timing is abnormal due to a jam as will be described below.

Sheet feeding sensors 1FS and 2FS are provided at the start end of the conveying route illustrated in FIG. 3, that is, the vicinity of the sheet feeding cassettes 11*a* and 11*b*. In response to the existence of the delay of the sheet passage timing indicated by the output, it is determined whether the feeding roller groups 12P, 12F, and 12R feed the sheets to the route at a normal timing.

In the route from the second sheet feeding cassette 11*b*, a longitudinal conveying sensor CS is provided at the front side of the first merging point MP1 in addition to a longitudinal conveying roller 13. In response to the existence of the delay of the sheet passage timing indicated by the output, it is determined whether the longitudinal conveying roller 13 delivers the sheets toward the first merging point MP1 at a normal timing.

In addition to the timing roller 14, a timing sensor TS is provided at the downstream side of any one of the first merging point MP1 and the second merging point MP2 in the vicinity of the boundary between the feeding part 10 and the imaging part 20. The timing roller 14 is generally stopped and also first stops the sheet moved from any one of the sheet feeding cassettes 11*a* and 11*b*, the hand insertion tray 16, and the circulation path 48. The timing roller 14 further starts to rotate at a timing indicated by the driving signal output from the main control unit 60 so as to deliver the stopped sheet toward the imaging part 20 at that timing.

In response to the existence of the delay of the sheet passage timing indicated by the output of the timing sensor TS, it is determined whether the sheet reaches the timing roller 14 at a normal timing or the sheet is delivered from the timing roller 14 at a normal timing. Further, the size of the sheet can be measured from the time necessary for the timing roller 14 to deliver each sheet.

A sheet discharging sensor ES is provided at the upstream side of the branch point BP. In response to the existence of the delay of the sheet passage timing indicated by the output, it is determined whether the front sheet discharging roller 33 delivers a sheet at a normal timing or the sheet discharging roller 43 or the reversing roller 45 draws a sheet at a normal timing.

The circulation path 48 is provided with conveying sensors 1RS and 2RS. In response to the existence of the delay of the sheet passage timing indicated by the output, it is determined whether the conveying rollers 48*a* to 48*d* of the circulation path 48 convey a sheet at a normal timing.

Although not illustrated in FIG. 3, a plurality of optical sensors is also provided in the conveying routes of the relay unit 140 and the post-processing device 150. The post-processing device 150 detects the position of the sheet being conveyed on the route by using these sensors and transmits the detection result to the main control unit 60 of the MFP 100. Based on the detection result, it is determined whether the conveying timing is abnormal and a conveying error such as a jam occurs on the conveying routes of the relay unit 140 and the post-processing device 150.

When the jam occurring in the current conveyed sheet is detected, a current printing job or the like is interrupted. A user can solve the jam by opening or closing an outer cover (not illustrated) for the MFP 100, the relay unit 140, and the post-processing device 150 and manually removing the sheet stopped on the conveying route due to the jam. When the jam is solved, the interrupted job is resumed.

Referring to FIG. 3, driving motor groups M1 to M12, TM, MM, FM, SM, and RM of the roller group 12P and the like and driving solenoids SL1 and SL2 of the switching claw 41 and the branch claw 162 are provided in the periphery of the conveying route. Each of the motor M1 and the like is, for example, a DC brushless (BLDC) motor and is generally rotatable in both the normal and reverse rotation directions. Each of the motor M1 and the like applies a rotation force to a roller as a driving target through a transmission system including a gear, a belt, and the like. The solenoids SL1 and SL2 move movable iron cores (plunger) in the axial direction by using an electromagnet and press and pull the switching claw 41 and the branch claw 162 so as to swing the claws upward and downward.

In the vicinity of the sheet feeding cassettes 11*a* and 11*b*, the feeding motors M1 and M2 rotate the feeding roller groups 12P, 12F, and 12R. In the vicinity of the route extending from the second sheet feeding cassette 11*b*, the longitudinal conveying motor M3 rotates the longitudinal conveying roller 13. In the vicinity of the route extending from the hand insertion tray 16, the feeding motor M4 rotates the feeding roller 15.

In the vicinity of the boundary between the feeding part 10 and the imaging part 20, the timing motor TM rotates the timing roller 14. In the imaging part 20, the main motor MM rotates the driving roller 23R of the intermediate transfer belt 23. In the fixing part 30, the fixing motor FM rotates the fixing roller 31 and the front sheet discharging roller 33.

In the delivering part 40, the sheet discharging motor SM rotates the sheet discharging roller 43 and the reversing motor RM rotates the reversing roller 45 in both the normal and reverse rotation directions. Here, the rotation of the reversing motor RM during the normal rotation of the reversing roller 45 will be referred to as the normal rotation and the rotation of the reversing motor RM during the reverse rotation of the reversing roller 45 will be referred to as the reverse rotation. The switching solenoid SL1 swings the switching claw 41 upward and downward. In the circulation path 48, one motor M5 rotates front conveying rollers 48*a* and 48*b* and another motor M6 rotates rear conveying rollers 48*c* and 48*d*.

In the relay unit 140, the conveying motor M7 rotates the conveying roller group 141 and the like. In the post-processing device 150, the first motor M8 rotates the entrance conveying roller 161, the solenoid SL2 swings the branch claw 162 upward and downward, the second motor M9 rotates the upper sheet discharging roller 163, and the third motor M10 rotates the conveying roller group 164. The fourth motor M11 rotates the reversing roller 165 in both the normal and reverse rotation directions and the fifth motor M12 rotates the lower sheet discharging roller 167.

—Sheet Conveying Operation in Duplex Printing Mode—

The conveying part conveys a sheet from the sheet feeding cassettes 11*a* and 11*b* toward the post-processing device 150 through the image forming units 10, 20, 30, and 40 and the relay unit 140 by using the conveying roller group 12P and the like illustrated in FIG. 3. Particularly in the duplex printing mode, a sheet having an image printed on a front surface thereof is reversed by the reversing port 44 and is returned to the conveying path through the circulation path 48 while the sheet is reversed.

Figure 4A:
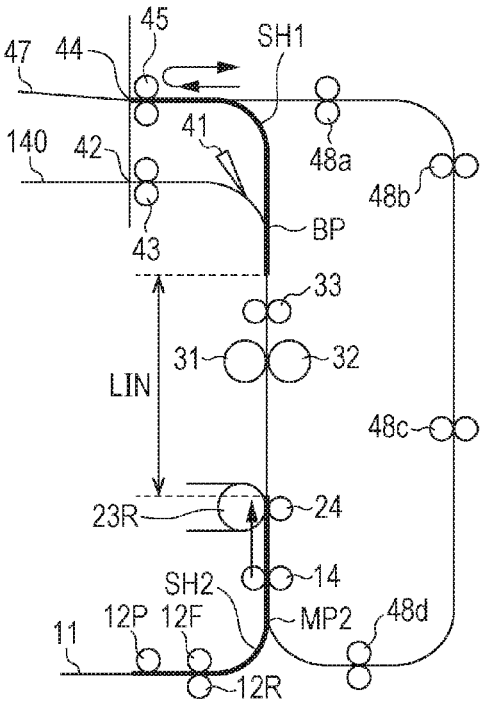
FIGS. 4A to 4D are schematic diagrams gradually illustrating a state where a sheet group is conveyed on the route in a duplex printing mode.
Figure 4B:
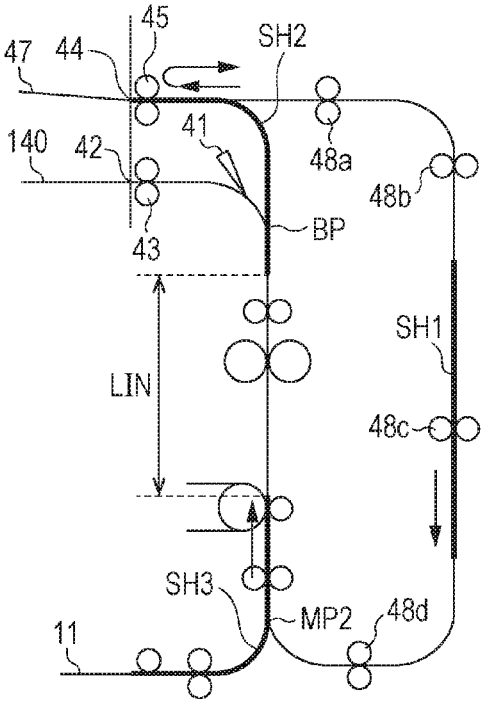
Figure 4C:
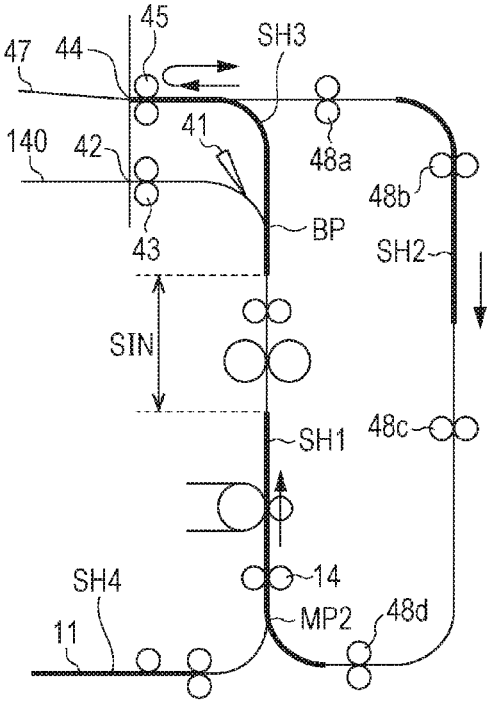
Figure 4D:
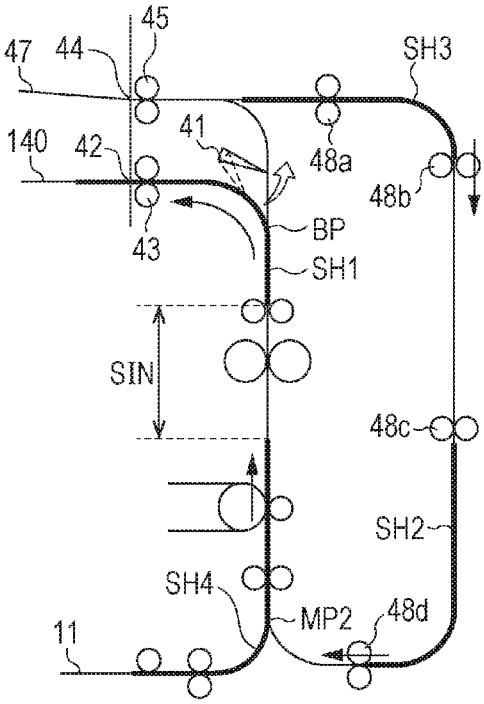

FIGS. 4A to 4D are schematic diagrams gradually illustrating a state where a sheet group is conveyed on the route in the duplex printing mode. FIG. 4A illustrates a state where an image is continuously printed on the front surfaces of the first two sheets SH1 and SH2, FIG. 4B illustrates a state where an image is printed on the front surface of the third sheet SH3, FIG. 4C illustrates a state where an image is printed on the rear surface of the first sheet SH1, and FIG. 4D illustrates a state where an image is printed on the front surface of the fourth sheet SH4.

As illustrated in FIG. 4A, the first two sheets SH1 and SH2 are continuously delivered from the sheet feeding cassette 11 toward the conveying path. At this time, since the switching claw 41 moves the front end downward so as to form the reversing path at the branch point BP in advance, the first sheet SH1 moves from the branch point BP toward the reversing port 44 along the reversing path so as to be reversed therein. The timing roller 14 delivers the next sheet SH2 so that a gap LIN between the leading end of the next sheet SH2 in the conveying direction and the tail end of the first sheet SH1 in the conveying direction becomes a predetermined gap. Particularly based on the sheet conveying speed of the conveying part, the gap LIN is set so that the next sheet SH2 reaches the reversing port 44 after the time point in which the reversing roller 45 delivers the first sheet SH1 from the reversing port 44 toward the circulation path 48. Hereinafter, the leading end in the sheet conveying direction will be referred to as the leading end of the sheet and the tail end in the sheet conveying direction will be referred to as the tail end of the sheet.

As illustrated in FIG. 4B, when the second sheet SH2 reaches the branch point BP, the switching claw 41 keeps the reversing path while moving the front end downward. Thus, the second sheet SH2 moves along the reversing path from the branch point BP toward the reversing port 44 so as to be reversed therein. Meanwhile, when the third sheet SH3 is delivered from the sheet feeding cassette 11 toward the conveying path, the timing roller 14 widens the gap LIN between the leading end of the third sheet SH3 and the tail end of the second sheet SH2 to a predetermined gap. Accordingly, the third sheet SH3 reaches the reversing port 44 after the time point in which the reversing roller 45 delivers the second sheet SH2 from the reversing port 44 toward the circulation path 48.

As illustrated in FIG. 4C, when the third sheet SH3 reaches the branch point BP, the switching claw 41 keeps the reversing path while moving the front end downward. Thus, the third sheet SH3 moves along the reversing path from the branch point BP to the reversing port 44 so as to be reversed therein. Meanwhile, when the first sheet SH1 is returned from the circulation path 48 to the second merging point MP2, the timing roller 14 delivers the first sheet SH1 fast by narrowing a gap SIN between the leading end of the first sheet SH1 and the tail end of the third sheet SH3 to a gap narrower than the gap LIN. Accordingly, the fourth sheet SH4 is movable on the conveying path earlier than the second sheet SH2.

As illustrated in FIG. 4D, the switching claw 41 moves the front end upward so as to switch the sheet conveying destination to the delivery path before the first sheet SH1 reaches the branch point BP. Thus, the first sheet SH1 is delivered from the sheet discharging port 42 toward the relay unit 140 along the delivery path extending from the branch point BP. Meanwhile, the fourth sheet SH4 is delivered from the sheet feeding cassette 11 toward the conveying path earlier than the time point in which the second sheet SH2 returns from the circulation path 48 toward the second merging point MP2. At this time, the timing roller 14 delivers the fourth sheet SH4 fast by narrowing the gap SIN between the leading end of the fourth sheet SH4 and the tail end of the first sheet SH1 to a gap narrower than the gap LIN and causes the second sheet SH2 to be movable on the conveying path.

In this way, the conveying part alternately conveys a sheet supposed to have an image printed on a front surface and a sheet supposed to have an image printed on a rear surface at an appropriate timing. Accordingly, since the contact of the sheets at the reversing port 44 is prevented, the reliability and the productivity of the MFP 100 are maintained highly.

[Electronic Control System of Image Forming System]

Figure 5:
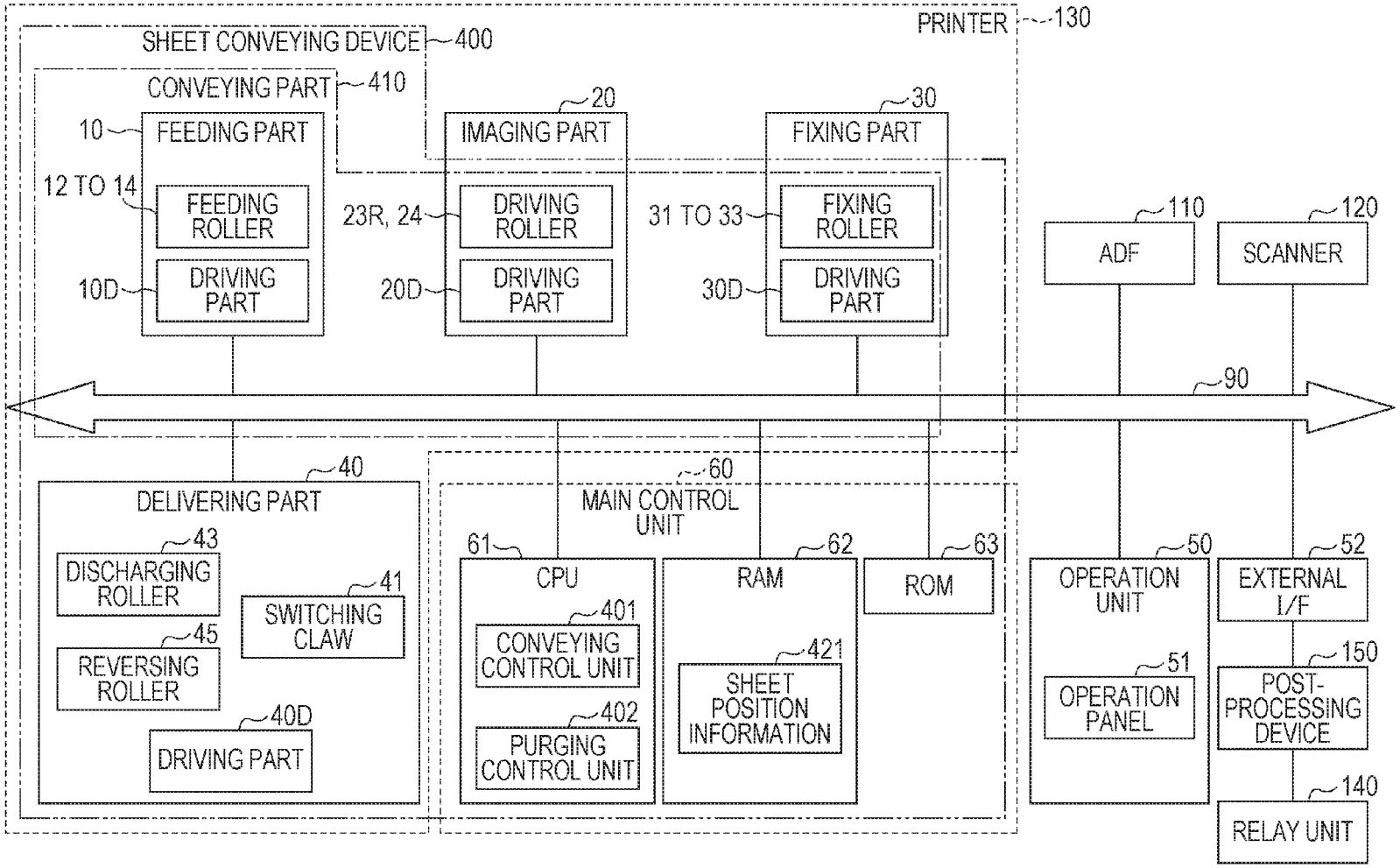
FIG. 5 is a block diagram illustrating the configuration of an electronic control system of a MFP.

FIG. 5 is a block diagram illustrating the configuration of the electronic control system of the MFP 100. As illustrated in FIG. 5, in the electronic control system, an operation unit 50, an external interface (I/F) 52, and the main control unit 60 are connected to one another via a bus 90 so as to communicate with one another in addition to the ADF 110, the scanner 120, and the printer 130.

—Operation Unit—

The operation unit 50 receives a requested job and image data of a printing target through the operation of the user or the communication with the external electronic device and transmits the requested job and the image data to the main control unit 60. As illustrated in FIG. 5, the operation unit 50 includes an operation panel 51. As illustrated in FIG. 1, the operation panel 51 is provided at the front surface of the casing of the MFP 100 and includes a push button, a touch panel, and a display.

The operation unit 50 controls the operation panel 51 so as to display a GUI screen including an operation screen and an input screen for various parameters on the display. Further, the operation unit 50 identifies the position of the push button or the touch panel operated by the user and transmits the identification information as operation information to the main control unit 60. The input information includes, for example, the setting of the type of sheet (which may be a normal sheet, a thin sheet, or the like) received in the sheet feeding cassette 11 or the hand insertion tray 16 and the designation of the number of the sheets to be staple-bound. Further, the display screen includes a message indicating a state where a jam (paper jam) occurs in the current conveyed sheet.

—External I/F—

The external I/F 52 includes a USB port or a memory card slot and directly takes image data of a printing target from an external storage device such as a USB memory or a hard disk drive (HDD) therethrough. Also, the external I/F 52 is connected to an external network (which is not illustrated in FIG. 5) in a wired or wireless state and receives image data of a printing target from other electronic devices on a network. Further, the external I/F 52 is connected to the electronic control system of the post-processing device 150 so as to relay data between the electronic control system and the main control unit 60.

—Main Control Unit—

The main control unit 60 is an electronic circuit mounted on one substrate and the substrate is provided inside the MFP 100. As illustrated in FIG. 5, the main control unit 60 includes a CPU 61, a RAM 62, and a ROM 63. The CPU 61 controls the other components 10, 20, and the like connected to the bus 90 according to firmware. The RAM 62 provides a working area for executing the firmware by the CPU 61 for the CPU 61 and stores the image data of the printing target received by the operation unit 50. The ROM 63 includes a non-writable semiconductor memory device and a writable semiconductor memory device such as an EEPROM or a HDD. The former stores firmware and the latter provides a storage area for an environment variable for the CPU 61.

When the CPU 61 executes various kinds of firmware, the main control unit 60 controls other components inside the MFP 100 based on the operation information from the operation unit 50. Specifically, the main control unit 60 receives a user's operation by displaying an operation screen on the operation unit 50. In response to the operation, the main control unit 60 determines an operation mode such as an operating mode, a standby mode, and a sleep mode, notifies the operation mode to other components by a driving signal, and performs a process in response to the operation mode for each component.

For example, when the operation unit 50 receives a printing job from the user, the main control unit 60 first transmits the image data of the printing target in the operation unit 50 to the RAM 62. Next, the main control unit 60 designates the type and the feeding timing of the sheet to be fed in the feeding part 10 in accordance with the printing condition indicated by the job, provides image data indicating a toner image to be formed for the imaging part 20, designates the surface temperature to be kept of the fixing roller 31 in the fixing part 30, and designates the sheet conveying destination and the switching timing at the branch point BP in the delivering part 40.

Further, the main control unit 60 monitors the operation state or the sheet conveying state of each of the components 10, 20, and the like of the MFP 100. Then, when a problem in any one of the components is detected, the operation mode is appropriately changed so as to solve the problem. For example, when the abnormal delay of the sheet conveying timing is detected by the optical sensor 1FS and the like illustrated in FIG. 3, the process of the printer 130 is interrupted and a message indicating the "occurrence of the jam" is displayed on the operation panel 51 so that the user can promptly solve the problem. When the paper pieces of the sheet feeding cassettes 11*a* and 11*b* or the insufficient toner amounts of the imaging unit 21Y and the like are detected, the process of the printer 130 is interrupted and a message indicating a "state where paper is torn and toner is not sufficient" is displayed on the operation panel 51 so that the user replenishes the paper and the toner.

As illustrated in FIG. 5, the main control unit 60 includes a conveying control unit 401 and a purging control unit 402. The function units 401 and 402 are realized when the CPU 61 executes dedicated firmware. That is, the function units 401 and 402 constitute a sheet conveying device 400 of the MFP 100 along with the conveying part 410. The conveying control unit 401 controls the operation of the sheet conveying device 400 in the normal job. The purging control unit 402 purges the sheet conveying device 400 when the process of the printer 130 is interrupted in response to a problem such as a jam. The function units 401 and 402 will be described in detail later.

—Printer—

As illustrated in FIG. 5, the components 10, 20, 30, and 40 of the printer 130 respectively include driving parts 10D, 20D, 30D, and 40D. The driving part 10D and the like control the motor M1 and the like along with the solenoid SL1 for driving various movable members included in the conveying part 410 in addition to the conveying roller group 12P and the like.

Further, the driving parts 10D, 20D, and the like monitor the operation state and the sheet conveying state of the components 10, 20, and the like of the MFP 100 by using various sensors and transmits a detection result to the main control unit 60. These sensors include a position sensor which detects the position or the posture of each of the photosensitive drum 25Y and the like as well as the movable member like the fixing roller 31, a sensor which detects the paper pieces of the sheet feeding cassettes 11*a* and 11*b*, and a sensor which detects the insufficient toner amounts of the imaging unit 21Y and the like in addition to the optical sensor 1FS and the like illustrated in FIG. 3.

[Conveying Control Unit]

The conveying control unit 401 controls the driving parts 10D, 20D, and the like as below in response to the operation mode and the job condition of the MFP 100 and conveys an appropriate sheet to the conveying part 410 at an appropriate timing.

The conveying control unit 401 first instructs the driving part 10D of the feeding part 10 to select a sheet feeding cassette as a sheet feeding source and to pick up a sheet by the feeding rollers 12P, 15, and the like from the sheet feeding cassette at a certain timing. In response to the instruction, the conveying control unit 401 causes each of the driving part 10D and the like to monitor each sheet conveying state of the feeding part 10 so as to particularly track a position on the conveying route. Specifically, the conveying control unit 401 measures an elapse time from a time point in which a sheet is picked up by the feeding rollers 12P, 15, and the like by the use of a timer.

Since a standard value (that is, a system speed) is defined in the sheet conveying speed in accordance with each operation mode, the conveying control unit 401 periodically, for example, every several tens to several hundreds of milliseconds calculates each sheet movement distance based on the standard conveying speed and the elapse time from the pickup time point and calculates the position of the sheet at the current time point based on the value. The conveying control unit 401 stores the information on the position of each sheet calculated in this way in the RAM 62 as one item of sheet position information 421. The sheet position information 421 defines, for example, the sheet items in accordance with the conveying order.

Further, the conveying control unit 401 predicts a passage time in which each sheet passes through the installation positions of the optical sensor 1FS and the like based on the sheet position information 421. The conveying control unit 401 corrects the position of the sheet at the current time point based on an error between the prediction time and the actual passage time indicated by the output of the optical sensor and updates the position information 421 by the corrected value.

Next, the conveying control unit 401 instructs a delivery timing to the driving part 10D of the feeding part 10 so that the sheet in the timing roller 14 is delivered to the imaging part 20 and instructs a switching timing to the driving part 40D of the delivering part 40 so that the front end of the switching claw 41 is switched and the normal rotation of the reversing roller 45 is switched to the reverse rotation by using the sheet position information 421.

The conveying control unit 401 further detects the abnormal delay of the sheet conveying timing caused by a conveying error such as a jam based on the sheet position information 421, the output of the driving part 10D and the like, and the output of the optical sensor 1FS and the like. A case of the abnormal delay includes, for example, a case where an error between the passage time of the installation position of each of the optical sensor 1FS and the like predicted from the position information 421 and the actual passage time indicated by the output of the optical sensor exceeds an allowable range. In this case, even when the elapse time from the predicted passage time exceeds the allowable range, the output of the optical sensor does not indicate the actual passage of the sheet.

[Purging Control Unit]

The main control unit 60 performs purging by activating the purging control unit 402 when the process of the printer 130 is interrupted. The "purging operation" indicates an operation in which the conveyable sheet of the current conveyed sheets is automatically discharged from the conveying route. The purging destination is not limited to an original sheet discharging position such as a sheet discharging tray, and each sheet can be discharged to each sheet discharging position. As the reason of interrupting the process of the printer 130, for example, the following cases include: (1) a case where an instruction of stopping a job is transmitted from a user or an external device, (2) a case where the conveying control unit 401 detects a conveying error such as a jam or multi-feeding that occurs in any one of the components 10, 40, and the like of the conveying part 410, (3) a case where a conveying error such as a jam is notified from the post-processing device 150, and (4) a case where a problem such as paper pieces and insufficient toner or a problem in the components or sheets is notified from the components of the MFP 100.

In such a case, the purging control unit 402 first specifies the conveyable sheet located at the upstream side of the sheet which cannot be conveyed due to a jam or the like as a purging target from the sheet position information 421 and then determines the purging destination and the conveying order of each sheet. Then, the conveying part 410 continuously conveys to discharge these sheets to the purging destination according to the conveying order. Accordingly, since the conveyable sheet is removed from the conveying route, it is possible to promptly resume the process of the printer 130 after a problem interrupting the printing process or the like is solved in a manner such that a user removes the jammed sheet.

When a jam is detected inside the post-processing device 150, the reversing tray 47 of the MFP 100 is left as only the sheet discharging position in the conveying route illustrated in FIG. 3. Thus, the purging control unit 402 sets the reversing tray 47 as a purging destination. The purging control unit 402 performs the purging operation only when a first condition is satisfied as a purging condition.

In the first condition, no sheet exists immediately after the reversing operation starts by the reversing roller 45 at the jam detection time point. When the first condition is not satisfied, the purging operation is not performed and the sheet conveying operation is interrupted so that each sheet is stopped.

—Purging Control Case—

Figure 6A:
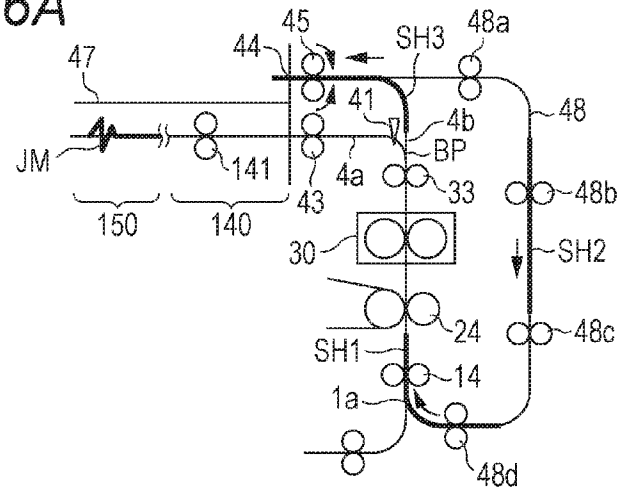
FIGS. 6A to 6D are schematic diagrams illustrating the positions of the sheets conveyed inside a printer at a time point in which a jam is detected by a post-processing device.

FIG. 6A is a schematic diagram illustrating the positions of the sheets SH1, SH2, and SH3 currently conveyed inside the printer 130 at the time point in which a jam JM is detected by the post-processing device 150. When the detection of the jam JM is notified from the post-processing device 150, the main control unit 60 interrupts the process of the printer 130 and activates the purging control unit 402.

The purging control unit 402 reads the sheet position information 421 from the RAM 62 and specifies the positions of three sheets SH1 to SH3 conveyed on the route at the current time point.

In FIG. 6A, the sheets SH1 to SH3 are all duplex printing targets. At the detection time point of the jam JM, the sheet SH1 having an image printed on the front surface is reversed and is returned from the circulation path 48 to the conveying path 1*a* so that an image will be printed on the rear surface, the sheet SH2 having an image printed on the front surface is reversed and is currently conveyed on the circulation path 48, and the sheet SH3 having an image printed on the front surface is currently conveyed on the reversing path 4*b* by the reversing roller 45 in a direction in which the sheet is discharged from the reversing port 44 (a direction indicated by the arrow of FIG. 6A). Hereinafter, the sheet conveying direction in a case where the sheet is conveyed toward the reversing port 44 will be referred to as the discharge direction and the sheet conveying direction in a case where the sheet is conveyed in a direction opposite to the discharge direction, that is, the sheet is conveyed in a direction moving away from the reversing port 44 will be referred to as the reversing direction.

At the detection time point, the tail end of the sheet SH3 has passed through the branch point BP and the printing process on the rear surface of the sheet SH1 is not started. For this reason, the switching claw 41 moves the front end downward so as to form a reversing path. When the jam JM does not occur, the front end of the switching claw 41 is moved upward so as to form a delivery path before the leading end of the sheet SH1 reaches the branch point BP.

The purging control unit 402 specifies the positions of the sheets SH1 to SH3 from the position information 421 and checks the next items when the jam JM is detected. First, it is checked whether the sheets SH1 to SH3 can be conveyed to the reversing tray 47 without the interference of the jam JM. Next, it is checked whether the sheet does not exist after the reversing operation of the reversing roller 45 is started at the detection time point of the jam JM. In FIG. 6A, the first condition is satisfied in that the sheet currently conveyed on the reversing path 4*b* in the discharge direction is not reversed yet.

Since the first condition is satisfied at the detection time point of the jam JM, the purging control unit 402 actually specifies the current conveyed sheets SH1 to SH3 as the purging target sheets and continuously conveys the sheets SH1 to SH3 to the conveying part 410 and the delivering part 40. The continuation includes the continuation of the normal rotation of the reversing roller 45. This corresponds to a state where the reversing operation of the sheet SH3, that is, the reverse rotation of the reversing roller 45 is prohibited. Accordingly, the sheet SH3 is conveyed in the discharge direction and is discharged from the reversing port 44 to the outside of the apparatus.

Further, the purging control unit 402 keeps the front end of the switching claw 41 downward. This means that the sheet conveying destination from the branch point BP by the switching claw 41 is not switched from the reversing port 44 to the delivery path 4*a* as the original conveying destination of the subsequent sheet SH1. Accordingly, since the sheet conveying destination from the branch point BP is held at the reversing port 44, the sheet SH1 first reaching the branch point BP can advance toward the reversing port 44.

The normal rotation of the reversing roller 45 and the sheet conveying destination fixed to the reversing port 44 are continued until all sheets as the purging targets are purged.

Figure 6B:
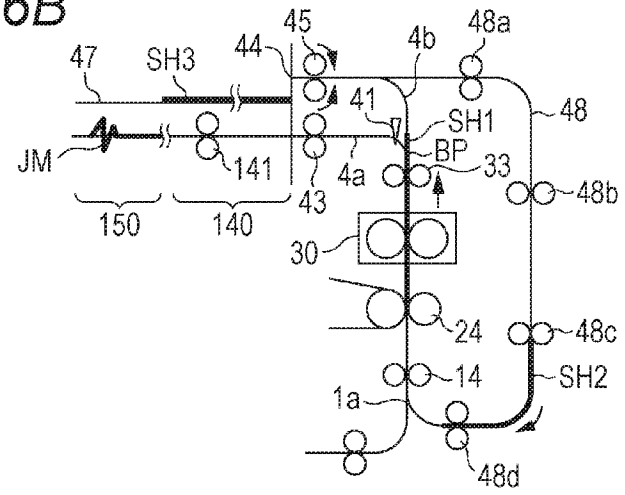
Figure 6C:
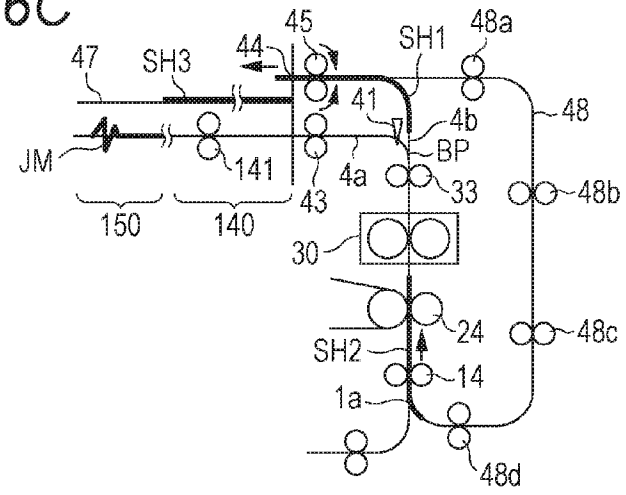
Figure 6D:
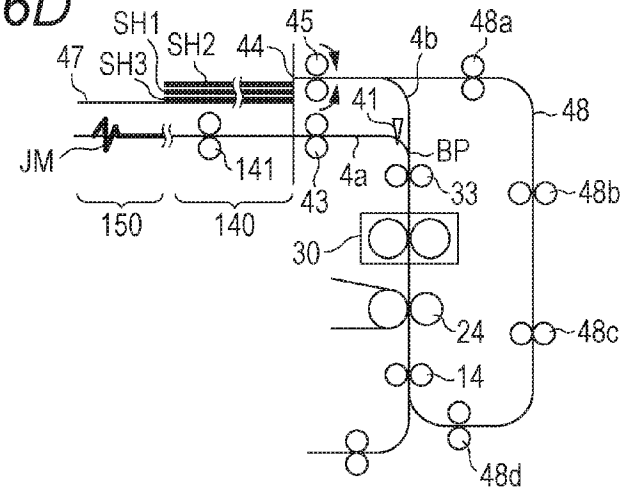

FIG. 6B illustrates a state where the sheet SH3 is purged from the reversing port 44 toward the reversing tray 47, the subsequent sheet SH1 advances from the branch point BP to the reversing port 44, and the subsequent sheet SH2 is conveyed on the circulation path 48. Further, FIG. 6C illustrates a state where the sheet SH1 is currently discharged from the reversing port 44 and the subsequent sheet SH2 is conveyed toward the branch point BP. Then, FIG. 6D illustrates a state where all sheets SH1 to SH3 as the purging targets are purged toward the reversing tray 47 and are placed on the reversing tray 47.

Figure 20:
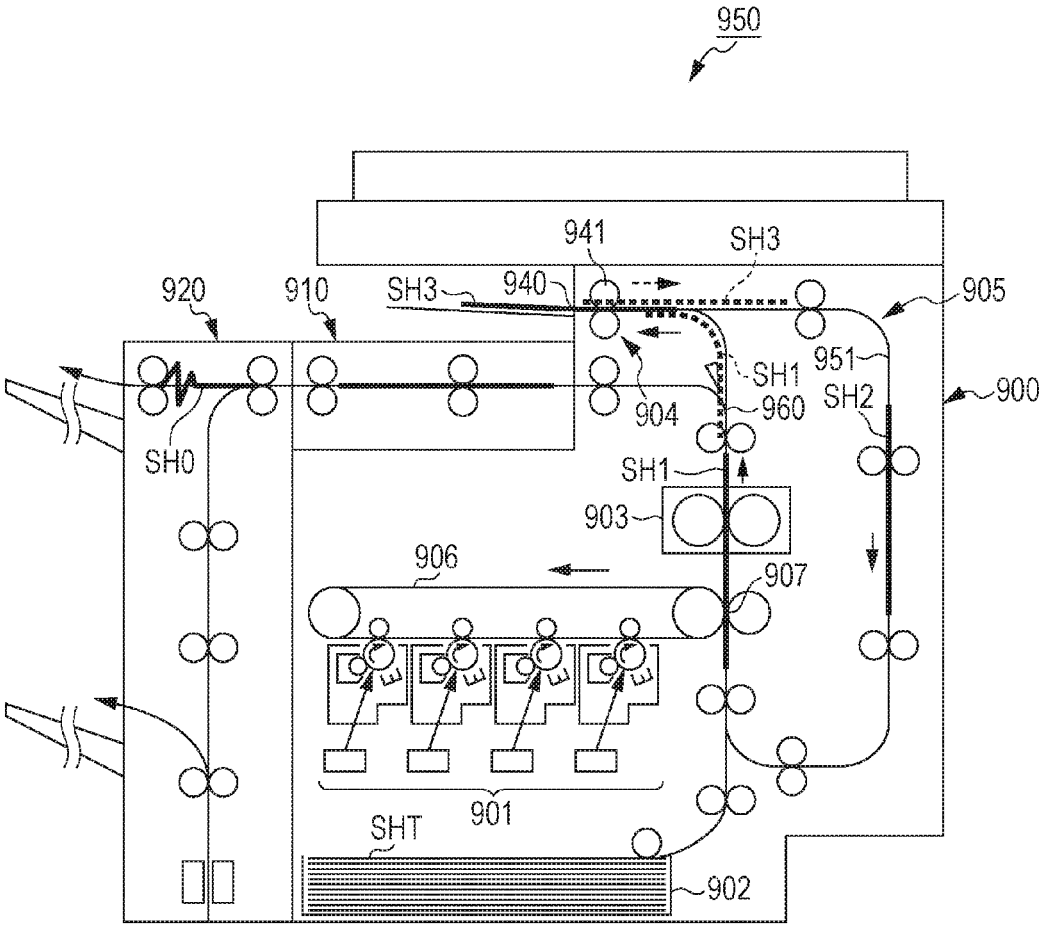
FIG. 20 is a diagram illustrating the schematic configuration of an image forming system of the related art.

In this way, since the conveying order of the sheets SH1 to SH3 as the purging targets is set as the order of SH3, SH1, and SH2 instead of the original order of SH1, SH2, and SH3, there is no need to worry about the collision between the sheets SH3 and SH1 illustrated in FIG. 20.

A user needs to remove the jammed sheet by opening and closing the outer cover. However, the sheets SH1 to SH3 stacked on the reversing tray 47 can be removed without opening and closing the outer cover if the user stretches out his or her hand toward the reversing tray 47 so as to remove the sheets SH1 to SH3. Accordingly, it is possible to reduce the effort of the user that performs the jam removing operation compared with the case where all sheets stopped at different positions inside the apparatus are removed one by one while the outer cover is opened and closed.

In FIG. 6A, an example has been described in which the sheet conveying destination does not need to be switched in that the sheet conveying destination of the switching claw 41 is set to the reversing port 44 at the detection time point of the jam JM. However, when the sheet conveying destination is the delivery path 4*a* at the detection time point of the jam JM, the sheet conveying destination may be switched from the delivery path 4*a* to the reversing port 44 by the operation of the switching claw 41.

However, when a certain time Ts (for example, about 1 second) is needed to switch the sheet conveying destination, there is a need to satisfy the switching condition in which the operation of switching the sheet conveying destination by the switching claw 41 ends until the leading end of the sheet SH1 reaches the branch point BP in order to guide the current conveyed sheet SH1 reaching the branch point BP at the first time from the branch point BP to the reversing path 92 as illustrated in FIG. 6A.

Figure 7:
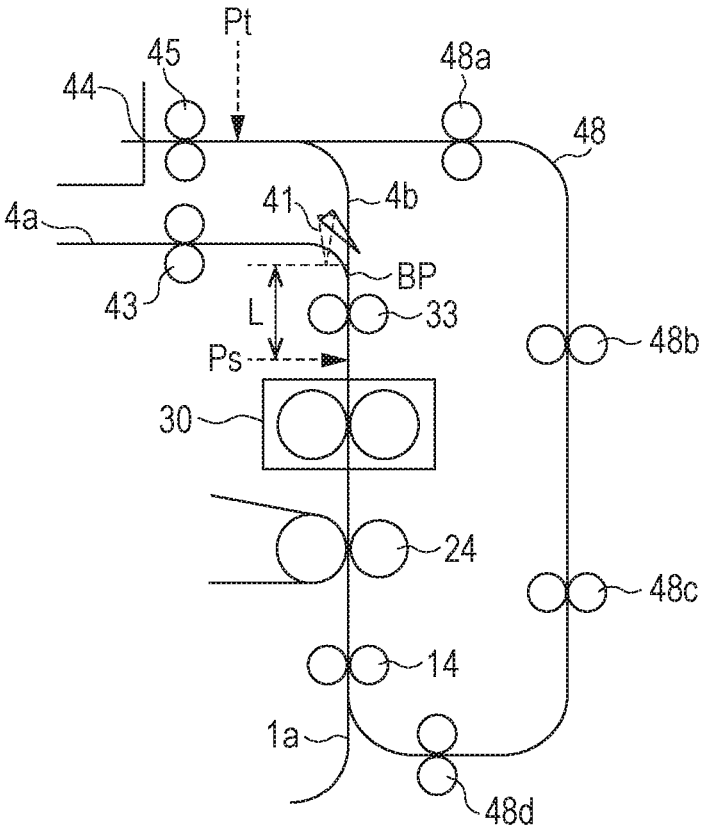
FIG. 7 is a schematic diagram illustrating a branch point BP and positions Ps and Pt defined on the conveying route.

That is, the sheet conveying speed V is constant as the system speed. Accordingly, as illustrated in FIG. 7, when a position located at the upstream side in the conveying direction by a distance L (=V×Ts) from the branch point BP in denoted by Ps, the switching condition is satisfied if the current position of the leading end of the sheet is the upstream position of the position Ps in the conveying direction at the detection time point of the jam JM. When the switching condition is satisfied, it is possible to purge the sheet reaching the branch point BP at the first time and the subsequent sheet thereof.

In the description above, a configuration has been described in which the purging operation is performed when the first condition is satisfied as the purging condition in which the sheet conveyed on the reversing path 4*b* in the discharge direction and not reversed yet exists when the jam JM is detected. However, a second condition may be further provided and the purging operation may be performed when the second condition is satisfied although the first condition is not satisfied.

The second condition indicates a condition in which a reversed sheet exists when the jam JM is detected and a jam does not occur due to the contact with a different sheet drawn from the branch point BP to the reversing path 4*b* during an operation (hereinafter, referred to as a "re-reversing operation") in which the sheet reversing operation is stopped and the conveying direction is returned to the discharge direction again.

Figure 8A:
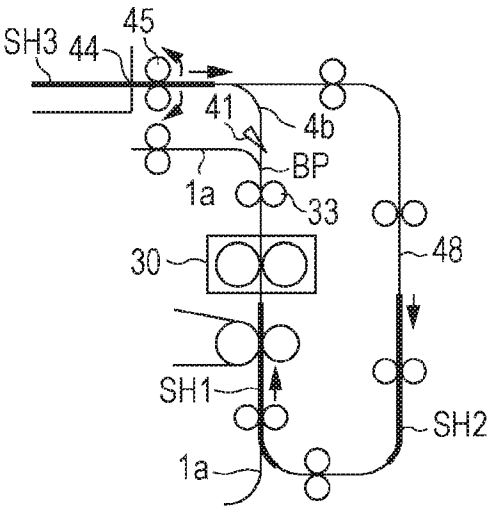
FIGS. 8A to 8C are schematic diagrams illustrating an example of the flow of the sheet in a purging control when a second condition is satisfied.
Figure 8B:
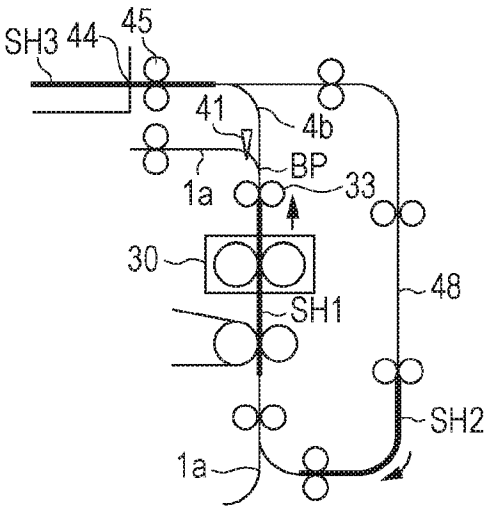
Figure 8C:
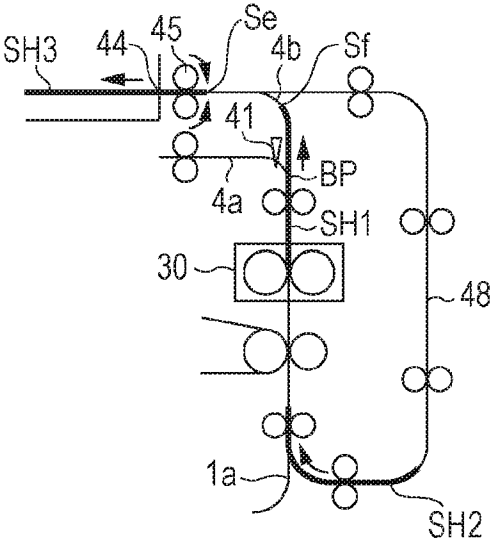

FIGS. 8A to 8C are schematic diagrams illustrating an example of a flow of a sheet when the purging control is performed in the case where the second condition is satisfied. FIG. 8A illustrates a state where the sheet SH3 having an image printed on the front surface starts to be reversed, the sheet SH1 having an image printed on the front surface is reversed and is returned from the circulation path 48 to the conveying path 1*a* so that an image is currently printed on the rear surface, and the sheet SH2 having an image printed on the front surface is reversed and is conveyed on the circulation path 48.

By the purging control, the reversing operation of the sheet SH3 is stopped as illustrated in FIG. 8B. The reversing operation of the sheet SH3 is stopped in a manner such that the purging control unit 402 instructs the driving part 40D to stop the rotation of the reversing motor RM and the rotation of the reversing roller 45 is stopped. Accordingly, the sheet SH3 is temporarily stopped, but the sheets SH1 and SH2 are continuously conveyed. Before the leading end of the sheet SH1 reaches the branch point BP, the sheet conveying destination of the sheet SH1 is switched to the reversing port 44 by the switching claw 41.

After the sheet SH3 is stopped, the re-reversing operation of the sheet SH3 is started as illustrated in FIG. 8C. The re-reversing operation of the sheet SH3 is performed in a manner such that the purging control unit 402 instructs the driving part 40D to rotate the reversing motor RM in the normal rotation direction and the reversing roller 45 is rotated in the normal rotation direction. Accordingly, the re-reversing operation of the sheet SH3, that is, the conveying operation thereof toward the reversing port 68 in the discharge direction is started.

In FIG. 8C, the leading end Sf of the subsequent sheet SH1 considerably approaches the tail end Se of the precedent sheet SH3, but the sheet SH3 and the sheet SH1 are conveyed at the same system speed. Accordingly, there is no need to worry about a jam caused by the collision of both sheets. After the sheet SH3 is discharged from the reversing port 44, the sheets SH1 and SH2 are sequentially discharged from the reversing port 44.

As for the purging control which is performed after the sheet SH3 starts to be reversed at the detection time point of the jam JM, the purging control may be performed only when the sheets SH3 and SH1 do not contact each other, for example, on the assumption that the sheet SH3 being reversed is re-reversed and the sheet SH1 reaching the branch point BP at the first time is continuously conveyed. In this configuration, the second condition is set as the condition in which the sheets SH3 and SH1 do not contact each other.

Instead, the second condition can be set to a relation of Tb<Ta, for example, on the assumption that the time necessary until the leading end of the sheet SH1 conveyed currently at the detection time point of the jam JM reaches the reversing roller 45 is denoted by Ta and the time necessary until the conveying speed obtained when the sheet SH3 is re-reversed from the reversing operation and conveying operation stop states rises to the system speed (when the reversing operation is completely switched to the re-reversing operation) is denoted by Tb.

The relation of Tb<Ta indicates a state where the conveying speed of the re-reversed sheet SH3 is stabilized at the system speed and the leading end of the sheet SH1 reaches the reversing roller 45. When the leading end of the sheet SH1 reaches the reversing roller 45, both sheets SH3 and SH1 are conveyed at the system speed. Thus, even when the leading end of the sheet SH1 overlaps the sheet SH3 immediately before reaching the reversing roller 45, the sheet can pass through the reversing roller 45 in the overlapping state since a speed difference with respect to the sheet SH3 hardly occurs. As a result, a jam is not caused by the contact between the sheets SH1 and SH3.

When the relation of Tb<Ta is used in the second condition, the purging operation can be allowed even when the sheets SH1 and SH3 contact each other. Accordingly, the purging control can be easily performed compared with the configuration of prohibiting the purging operation whenever the jam JM is detected and hence the effort of the user in the jam removing operation can be reduced.

The time Ta can be calculated in a manner such that a distance La on the conveying route (the conveying path 1*a* and the reversing path 4*b*) from the leading end of the sheet SH1 to the position of the reversing roller 45 is obtained based on the current position of the sheet SH1 at the detection time point of the jam JM and the obtained distance La is divided by the system speed V.

The time Tb is defined as below. That is, on the assumption that the rotation of the reversing motor RM is divided into the normal rotation in which the sheet SH3 is conveyed toward the reversing port 44 (including the re-reversing operation) and the reverse rotation in which the sheet SH3 is reversed, the time Tb is obtained by adding a time tb1 necessary until the reversing motor RM is actually stopped after the stop of the reversing motor RM rotating in the reverse rotation direction is instructed, a stop time tb2, and a time tb3 necessary until the rotation speed rises to a rotation speed Vc corresponding to the system speed V after the normal rotation of the reversing motor is started.

Figure 9A:
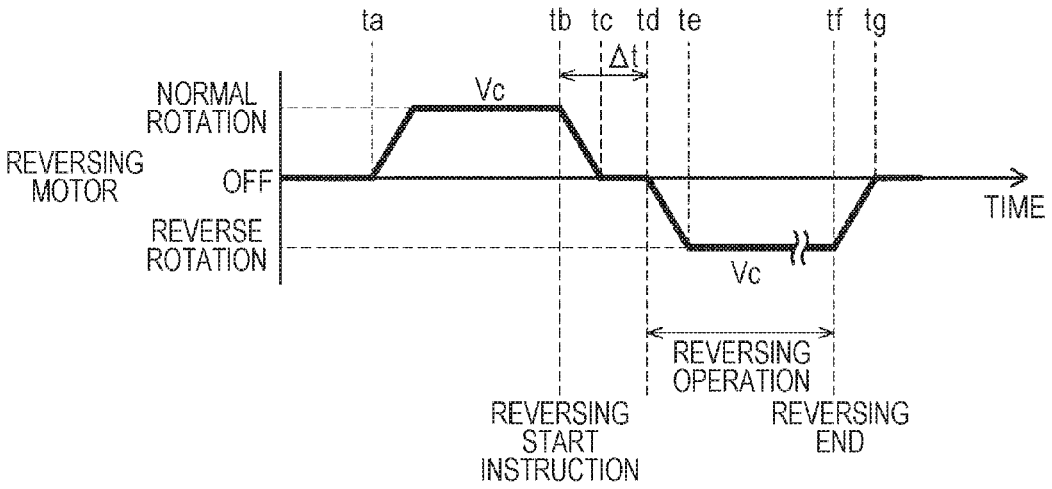
FIG. 9A is a diagram illustrating an example of a timing chart when a normal rotation of a reversing motor is changed to a reverse rotation thereof (when a re-reversing operation is not performed) and FIG. 9B is a diagram illustrating an example of a timing chart when the normal rotation of the reversing motor is changed to the reverse rotation thereof or the reverse rotation of the reversing motor is changed to the normal rotation thereof (when the re-reversing operation is performed)
Figure 9B:
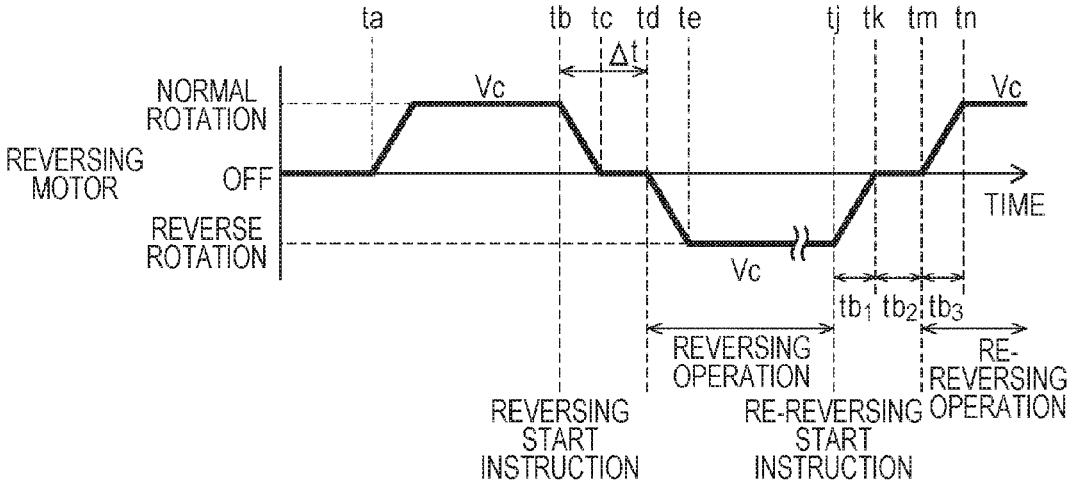

FIG. 9A is a diagram illustrating an example of a timing chart in which the normal rotation of the reversing motor RM is switched to the reverse rotation thereof (the re-reversing operation is not performed). FIG. 9B is a diagram illustrating an example of a timing chart in which the normal rotation of the reversing motor RM is switched to the reverse rotation thereof and the reverse rotation of the reversing motor is switched to the normal rotation thereof (the re-reversing operation is performed).

As illustrated in FIG. 9A, when the normal rotation of the reversing motor RM is instructed at a time point ta, the normal rotation of the reversing motor RM is started so that the rotation speed rises. A supply current for accelerating the reversing motor RM is supplied from a driving driver (not illustrated) of the driving part 40D to the reversing motor RM.

When the rotation speed of the reversing motor RM reaches the rotation speed Vc corresponding to the system speed, the reversing motor rotates at the constant speed Vc until there is a reversing start instruction (a time point tb). Accordingly, the reversing roller 45 rotates at the system speed V in the normal rotation direction and the sheet SH3 is conveyed in the discharge direction so that the leading end of the sheet SH3 is discharged from the reversing port 44.

When the reversing start instruction is generated at the time point tb immediately before the tail end Se of the sheet SH3 reaches the reversing roller 45, the reversing motor RM is decelerated and stopped (a time point tc). The supply current from the driving part 40D toward the reversing motor RM is stopped or gradually decreased. Accordingly, the sheet SH3 which is currently conveyed in the discharge direction is also stopped temporarily.

The reversing motor RM is temporarily stopped between the time points tc to td. The stop time is provided due to the following reasons.

That is, when the stop time is not provided between the normal rotation of the reversing motor RM and the reverse rotation thereof, a current for the reverse rotation is supplied to the reversing motor RM in the normal rotation state. In many cases, the supply current is larger than a normal starting current. For this reason, a current larger than a normal current flows to the coil of the reversing motor RM or the driving driver and hence the normal and reverse rotations are not stable due to the heat generated from the reversing motor RM or the driving driver.

On the contrary, when the stop time is provided, a current for the reverse rotation is not supplied to the reversing motor RM during the normal rotation of the reversing motor RM and hence the normal and reverse rotations are more stably performed. The stop time is determined in advance in response to the specification of the reversing motor RM.

When the reverse rotation of the reversing motor RM is instructed at a time point td after the stop time ends, the reverse rotation of the reversing motor RM is started so that the rotation speed rises (the start of the sheet reversing operation). Accordingly, the reversing operation of the sheet SH3 is started.

When the rotation speed of the reversing motor RM reaches the rotation speed Vc (a time point te), the reversing motor RM rotates at the constant speed Vc until the stop of the reversing motor RM is instructed (a time point tf). Accordingly, the sheet SH3 is conveyed in the reversing direction.

When the stop of the reversing motor RM is instructed at the time point tf, the reversing motor RM is decelerated and stopped (a time point tg). The stop of the reversing motor RM is instructed at a time point in which the leading end of the reversed sheet SH3 passes through the conveying roller 48*a* of the circulation path 48 and the tail end of the sheet SH3 passes through the reversing roller 45.

Likewise, FIG. 9A illustrates an example of a timing chart in which the re-reversing operation is not performed during the reversing operation of the sheet SH. On the contrary, FIG. 9B illustrates an example of a timing chart in which the re-reversing operation is performed during the reversing operation.

As illustrated in FIG. 9B, when the re-reversing operation of the reversing motor RM is instructed at a time point tj during the reversing operation, the reversing motor RM is decelerated and stopped (a time point tk). Accordingly, the sheet SH3 which is currently conveyed in the reversing direction is also stopped.

The reversing motor RM is temporarily stopped between the time points tk to tm. The stop time is provided due to the same reason as the case where the stop time is provided between the time points tc to td.

When the stop time ends and the normal rotation of the reversing motor RM is instructed at a time point tm, the normal rotation of the reversing motor RM is started so that the rotation speed rises (the start of the sheet re-reversing operation). Accordingly, the re-reversing operation of the sheet SH3 is started.

When the rotation speed of the reversing motor RM reaches the rotation speed Vc (a time point tn), the reversing motor rotates at the constant speed Vc. Accordingly, the sheet SH3 is conveyed again in the discharge direction, that is, a direction toward the reversing port 68, and the sheet SH3 is discharged from the reversing port 44.

In FIG. 9B, a gap between the time points tj to tk corresponds to the time tb1, a gap between the time points tk to tm corresponds to the time tb2, and a gap between the time points tm to tn corresponds to the time tb3. Since the times tb1 to tb3 can be obtained in advance by an experiment for each apparatus in response to the configuration of the apparatus, the time Tb can be also obtained in advance for each apparatus.

In this way, even when the reversing operation of the reversing motor RM is instructed (the time point tb), the sheet SH3 actually starts to be conveyed in the reversing direction from the time point td, and the time between the time points tb to td becomes a delay time Δt. Since the gap between the time points tc to td in the delay time Δt is the stop time, there is a need to determine a reversing start instruction timing in advance so that the sheet SH3 starts to be conveyed in the reversing direction immediately before the tail end Se of the sheet SH3 passes through the reversing roller 45 in consideration of the distance Lb in which the sheet SH3 advances toward the reversing port 44 between the time points tb to tc as the deceleration zone.

In the embodiment, when the position Pt on the reversing path 4*b* illustrated in FIG. 7 is determined as an appropriate reversing start instruction position and the tail end Se of the sheet SH3 reaches the position Pt, the reversing start instruction is generated for the reversing motor RM (the time point tb of FIG. 9A). That is, the sheet SH3 starts to be reversed from the time point tb at which the tail end Se of the sheet SH3 reaches the position Pt.

The sheet SH3 advances toward the reversing port 44 by the distance Lb from the reversing start instruction and is reversed due to the reverse rotation of the reversing roller 45. Thus, the determination on whether the sheet SH3 existing on the reversing path 4*b* starts to be reversed at the detection time point of the jam JM changes before or after the reversing start instruction is generated for the sheet SH3.

Specifically, when the reversing start instruction is not generated for the sheet SH3 yet, it is determined that the sheet SH3 does not start to be reversed yet. Meanwhile, when the reversing start instruction is generated from the sheet SH3, it is determined that the sheet SH3 starts to be reversed even when the sheet SH3 does not actually start to be conveyed in the reversing direction (even between the time points tb to td of FIG. 9A).

<Sheet Conveying Control of Duplex Printing Job>

Figure 10:
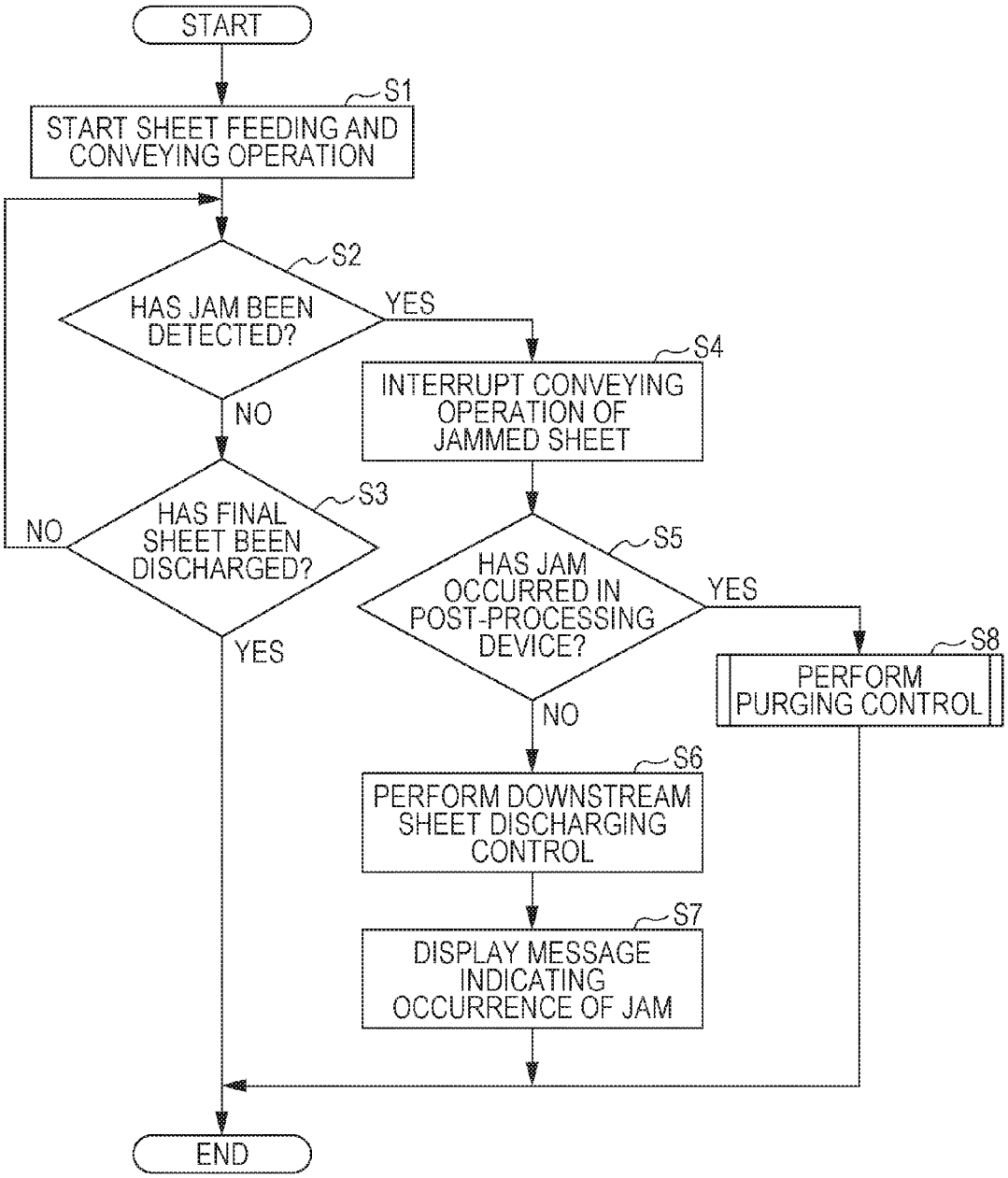
FIG. 10 is a flowchart illustrating an example of the content of a sheet conveying control in a duplex printing mode.

FIG. 10 is a flowchart illustrating an example of a sheet conveying control of a duplex printing job in which a plurality of sheets SH is fed one by one and a duplex printing process is performed on each sheet. The control is performed by the main control unit 60 by the unit of the printing job. In addition, the duplex printing job is a job not subjected to the post-processing.

A sheet feeding and conveying operation is started which feeds and conveys a plurality of sheets one by one from the sheet feeding cassette 11 or the hand insertion tray 16 (step S1).

The sheet feeding and conveying operation is performed according to the timing determined in advance for each sheet, for example, the sheet gap (the paper gap) with respect to the precedent sheet when the sheet is fed from the sheet feeding cassette 11, the conveying timing toward the imaging part 20, the reversing start timing of the reversing roller 45 for the reversing operation, and the conveying timing of the conveying roller 48*d* when the sheet is returned from the circulation path 48 to the conveying path 1*a*. Further, the sheet feeding and conveying operation also includes an operation in which a sheet having an image printed on a front surface is guided from the conveying path 1*a* to the reversing path 4*b* and a sheet having an image printed on a rear surface is guided from the conveying path 1*a* to the delivery path 4*a* by the switching claw 41.

Accordingly, for example, as illustrated in FIGS. 4A to 4D, each of sheets is fed and conveyed according to a predetermined conveying order so that an image is printed on front and rear surfaces thereof. Here, an image is printed on each of the front surfaces of the sheets SH1, SH2, and SH3, an image is printed on the rear surface of the sheet SH1, an image is printed on the front surface of the sheet SH4, and an image is printed on the rear surface of the sheet SH2.

It is determined whether a jam is detected during a job (step S2). When it is determined that the jam is not detected ("No" of step S2), it is determined whether a final sheet of the plurality of sheets is discharged from the post-processing device 150 (step S3).

When it is determined that the final sheet is not discharged from the post-processing device 150 ("No" of step S3), the routine returns to step S2. When a jam does not occur until the final sheet is discharged from the post-processing device 150, the processes of step S2 and step S3 are repeated. Then, when the final sheet is discharged from the post-processing device 150 ("Yes" of step S3), the corresponding control ends.

When it is determined that the jam is detected during the job ("Yes" of step S2), the conveying operation of the jammed sheet is interrupted (step S4). The interruption is performed in a manner such that a roller actually conveying the jammed sheet is specified and a motor rotationally driving the specified roller is stopped. The roller can be specified in a manner such that a roller existing at the current position on the jammed sheet conveying route among the rollers disposed on the conveying routes is specified. The current position of the jammed sheet is detected in the event of the jam. The information on the roller positions on the conveying routes is stored in advance.

It is determined whether a jam occurs in the post-processing device 150 (step S5). The determination is performed based on whether the main control unit 60 receives the detection result of the jam from the post-processing device 150. When it is determined that the jam does not occur in the post-processing device 150 ("No" of step S5), a downstream sheet discharging control is performed (step S6).

The downstream sheet discharging control is a control that continuously conveys a sheet existing at the downstream side of the jammed sheet in the conveying direction at the jam detection time point and discharges the sheet from the post-processing device 150. Accordingly, since the sheet existing at the downstream side of the jammed sheet in the conveying direction is not stopped while being left inside the apparatus, there is no need to perform a jam removing operation for the sheet. As a result, the effort of the user is reduced.

Then, a message indicating the occurrence of the jam is displayed on the operation panel 51 (step S7) and the corresponding control ends.

In addition, when the jam removing operation is performed so that the jammed sheet is removed from the inside of the apparatus by the user, a message indicating the occurrence of the jam is turned off and the interrupted printing job is resumed.

When it is determined that the jam occurs in the post-processing device 150 ("Yes" of step S5), a purging control is performed (step S8) and the corresponding control ends.

Figure 11:
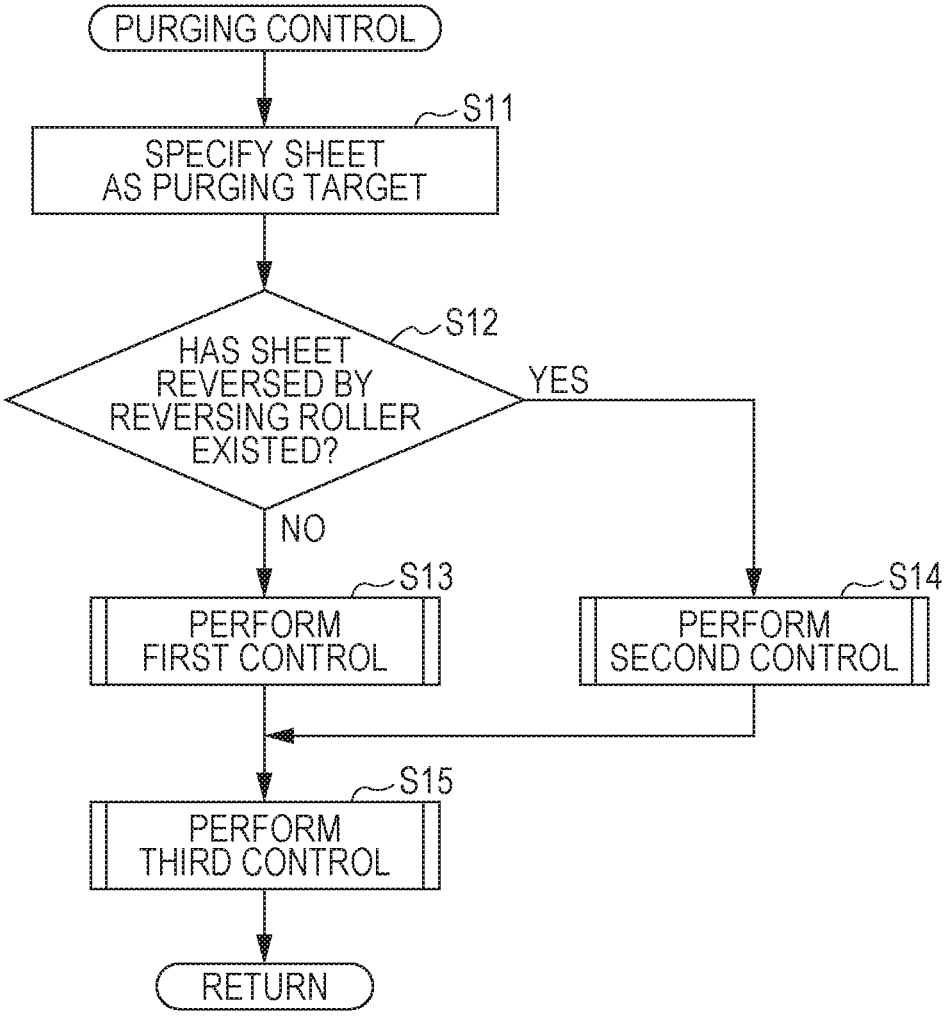
FIG. 11 is a flowchart illustrating the content of a subroutine of a purging control.

FIG. 11 is a flowchart illustrating the content of the sub-routine of the purging control. Then, in the purging control, the purging control unit 402 is activated by the main control unit 60.

As illustrated in FIG. 11, the purging control unit 402 specifies a sheet as a purging target (step S11). Specifically, the purging control unit 402 reads the sheet position information 421 from the RAM 62 and specifies the position of the sheet currently conveyed on the conveying route when the jam is detected. Next, it is determined whether the sheets can be conveyed without the interference of the jam from the position at the current time point to the reversing tray 47. The conveyable sheet is specified as a purging target. In the examples of FIGS. 6A to 6D, the sheets SH1 to SH3 are specified as purging targets.

Then, it is determined whether the sheet reversed by the reversing roller 45 exists (step S12). The determination indicating the existence of the reversed sheet is performed until the sheet conveying operation in the reversing direction by the reversing roller 45 ends (the time point tf) after the reversing start instruction (the time point tb) of FIG. 9A for the current state of one sheet. Thus, for example, when the first condition is satisfied, that is, the sheet currently conveyed on the reversing path 4*b* in the discharge direction exists and the current time point is earlier than the time point tb of FIG. 9A, it is considered that the reversing operation is not started yet.

When it is determined that the reversed sheet does not exist ("No" of step S12), the first control is performed (step S13), the third control is performed (step S15), and the routine returns. Meanwhile, when it is determined that the reversed sheet exists ("Yes" of step S12), the second control is performed (step S14) and the routine proceeds to step S15.

Figure 12:
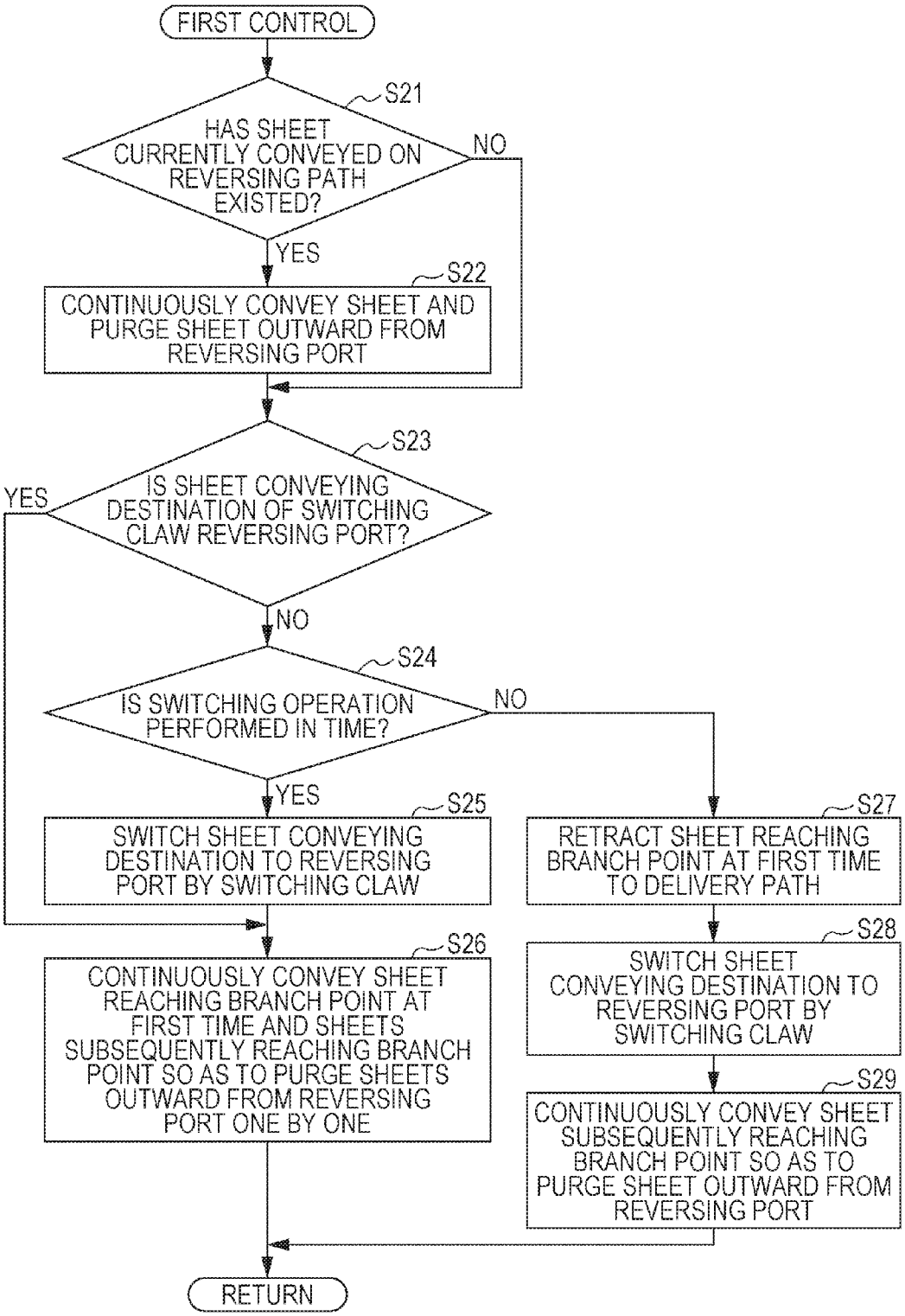
FIG. 12 is a flowchart illustrating the content of a subroutine of a first control.

FIG. 12 is a flowchart illustrating the content of the sub-routine of the first control.

As illustrated in FIG. 12, when the sheet currently conveyed on the reversing path 4*b* in the discharge direction exists ("Yes" of step S21), it is determined that the first condition is satisfied. Then, the sheet is continuously conveyed (the original reversing operation is prohibited), the sheet is purged outward from the reversing port 44 (step S22), and the routine proceeds to step S23. The purged sheet is placed on the reversing tray 47 (FIG. 6B).

When the sheet currently conveyed on the reversing path 4*b* does not exist ("No" of step S21), the routine proceeds to step S23.

In step S23, it is determined whether the current sheet conveying destination of the switching claw 41 is the reversing port 44. When it is determined that the current sheet conveying destination is the reversing port 44 ("Yes" of step S23), the routine proceeds to step S26.

When it is determined that the sheet conveying destination is not the reversing port 44 but the delivery path 4*a* ("No" of step S23), it is assumed that the sheet reaching the branch point BP at the first time is continued. Then, it is determined whether the operation in which the switching claw 41 switches the sheet conveying destination from the delivery path 4*a* to the reversing port 44 is performed in time until the leading end of the sheet reaches the branch point BP (step S24). The determination on whether the switching operation is performed in time is made when the above-described switching condition is satisfied, that is, the current position of the leading end of the sheet reaching the branch point BP at the first time is located at the upstream position of the position Ps illustrated in FIG. 7 in the conveying direction.

In addition, when the sheet conveying speed can be ignored with respect to the swinging speed of the switching claw 41, it is possible to form the reversing path 4*b* in the switching claw 41 before the leading end of the first sheet reaches the branch point BP regardless of the jam detection time point. In that case, the determination of step S24 may be omitted and the routine may proceed to step S25.

When it is determined that the sheet conveying destination is switched in time ("Yes" of step S24), the switching claw 41 changes the sheet conveying destination from the delivery path 4*a* to the reversing port 44 (step S25) and the routine proceeds to step S26. The sheet conveying destination is switched by the switching claw 41 in a manner such that the driving solenoid SL1 is driven.

In step S26, the sheet reaching the branch point BP at the first time and the sheets subsequently reaching the branch point are continuously conveyed (while not being reversed) and the sheets are purged outward from the reversing port 44 one by one. The purged sheet is placed on the reversing tray 47 (FIG. 6D). The routine returns after the process of step S26 is performed.

Meanwhile, when it is determined that the sheet conveying destination is not switched in time by the switching claw 41 ("No" of step S24), the sheet reaching the branch point BP at the first time is continuously conveyed and the sheet is retracted to the delivery path 4*a* (step S27). The sheet is retracted to the delivery path 4*a* in a manner such that the sheet is conveyed toward the relay unit 140 and the sheet conveying operation is stopped when the tail end of the sheet passes through the branch point BP. The sheet retracting operation toward the delivery path 4*a* corresponds to the prohibition of the purging operation for the sheet.

Then, the switching claw 41 switches the sheet conveying destination from the delivery path 4*a* to the reversing port 44 (step S28) and the sheet reaching the branch point BP at the next time and the sheets subsequently reaching the branch point are continuously conveyed (while not being reversed) so that the sheets are purged outward from the reversing port 44 one by one (step S29). After the process of step S29 is performed, the routine returns.

Figure 13:
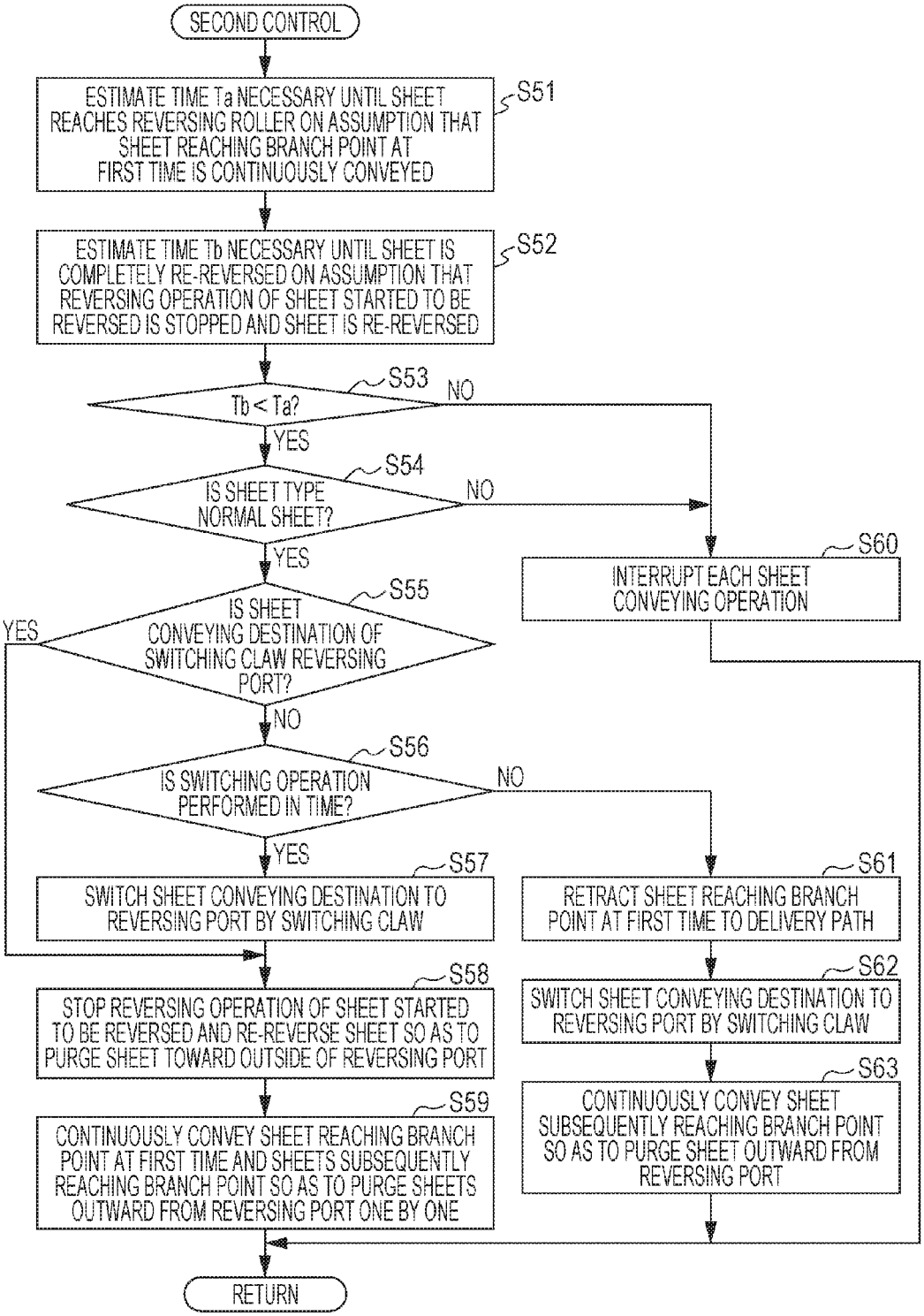
FIG. 13 is a flowchart illustrating the content of a subroutine of a second control.

FIG. 13 is a flowchart illustrating the content of the sub-routine of the second control.

As illustrated in FIG. 13, the time Ta necessary for the sheet to reach the reversing roller 45 is estimated on the assumption that the sheet reaching the branch point BP at the first time is continuously conveyed (step S51).

Then, when it is assumed that the reversing operation for the reversed sheet is stopped so that the sheet is re-reversed, the time Tb necessary until the switching to the re-reversing operation is completed is estimated (step S52). The times Ta and Tb are estimated as described above.

It is determined whether the time relation of Tb<Ta is satisfied (step S53). The determination corresponds to the determination on whether the second condition is satisfied. When it is determined that the time relation of Tb<Ta is satisfied ("Yes" of step S53), it is determined whether the reversed sheet is the normal sheet (step S54).

When it is determined that the current sheet is the normal ("Yes" of step S54), it is determined whether the switching claw 41 switches the sheet conveying destination to the reversing port 44 (step S55). When it is determined that the sheet conveying destination is the reversing port 44 ("Yes" of step S55), the routine proceeds to step S58.

When it is determined that the sheet conveying destination is the delivery path 4*a* ("No" of step S55), it is assumed that the sheet reaching the branch point BP at the first time is continuously conveyed. Then, it is determined whether the switching claw 41 switches the sheet conveying destination from the delivery path 4*a* to the reversing port 44 in time until the leading end of the sheet reaches the branch point BP (step S56). This determination is performed similarly to the method of step S24.

When it is determined that the sheet conveying destination is switched in time ("Yes" of step S56), the switching claw 41 switches the sheet conveying destination from the delivery path 4*a* to the reversing port 44 (step S57) and the routine proceeds to step S58.

In step S58, the reversing operation of the reversed sheet is stopped and the reversed sheet is re-reversed so that the sheet is purged outward from the reversing port 44 (FIGS. 8B and 8C).

Subsequently, in step S59, the sheet reaching the branch point BP at the first time and the sheets subsequently reaching the branch point BP are continuously conveyed (while not being reversed) so that the sheets are purged outward one by one from the reversing port 44. After the process of step S59 is performed, the routine returns.

Meanwhile, when it is determined that the time relation of Tb<Ta is not satisfied ("No" of step S53), the routine proceeds to step S60. Further, when it is determined that the reversed sheet is not the normal sheet ("No" of step S54), the routine proceeds to step S60.

In step S60, the sheet conveying operation to the device, that is, the post-processing device 150 is interrupted and the routine returns. The interruption of the sheet conveying operation corresponds to the prohibition of the purging operation for the sheet specified as the purging target.

The purging is prohibited due to the following reasons when the time relation of Tb<Ta is not satisfied. That is, if the sheet which is currently reversed is re-reversed when the relation is not satisfied, the sheets currently conveyed on the reversing path 4*b* toward the reversing roller 45 in the discharge direction contact each other before the sheet conveying speed during the re-reversing operation rises to the system speed. At this time, when there is a large difference in the conveying speed between both sheets, a friction force generated between both sheets also increases. Accordingly, since a new jam easily occurs during the conveying operation, the jam needs to be prevented.

Further, the purging operation is prohibited due to the following reasons when the reversed sheet (that is, the re-reversed sheet) is not the normal sheet. That is, in the case of, for example, a thin sheet other than the normal sheet, the thin sheet is easily curled due to the weak waist thereof. If the sheet is discharged by the purging operation from the reversing port 44 other than the original discharge port, the thin sheet immediately after passing out from the reversing port 44 is curled in a round shape in many cases. In this way, the sheet which is curled in a round shape on the reversing tray 47 collides with the leading end of the sheet subsequently discharged from the reversing port 44. Accordingly, there is a concern that the sheet is not satisfactorily discharged from the reversing port 44 and a jam occurs. If there is a concern that a new jam occurs even by the purging operation while the reversing operation is stopped, it is desirable not to perform both the reversing operation and the purging operation as the unnecessary extra operations of the printer 130. Thus, it is possible to prevent degradation in the operability of the user.

In addition, the processes of step S54 and step S60 may be integrated even in the first control. Further, when there is not substantially a concern for the jam due to the curl of the thin sheet, the determination of step S54 may be omitted and the purging operation may be performed regardless of the type of sheet.

When it is determined that the sheet conveying destination is not switched in time by the switching claw 41 ("No" of step S56), the sheet reaching the branch point BP at the first time is continuously conveyed and the sheet is retracted to the delivery path 4*a* (step S61). Then, the switching claw 41 switches the sheet conveying destination from the delivery path 4*a* to the reversing port 44 (step S62) and the sheet reaching the branch point BP at the next time and the sheets subsequently reaching the branch point BP are continuously conveyed (while not being reversed) so that the sheets are sequentially purged outward one by one from the reversing port 44 (step S63). The processes of step S61 to step S63 are similar to those of step S27 to step S29. In addition, the process of step S54 may be performed, for example, before the start of the process of step S51 or the start of the second control. When even the other steps can be controlled, the order may be different from the order illustrated in the drawing.

Figure 14:
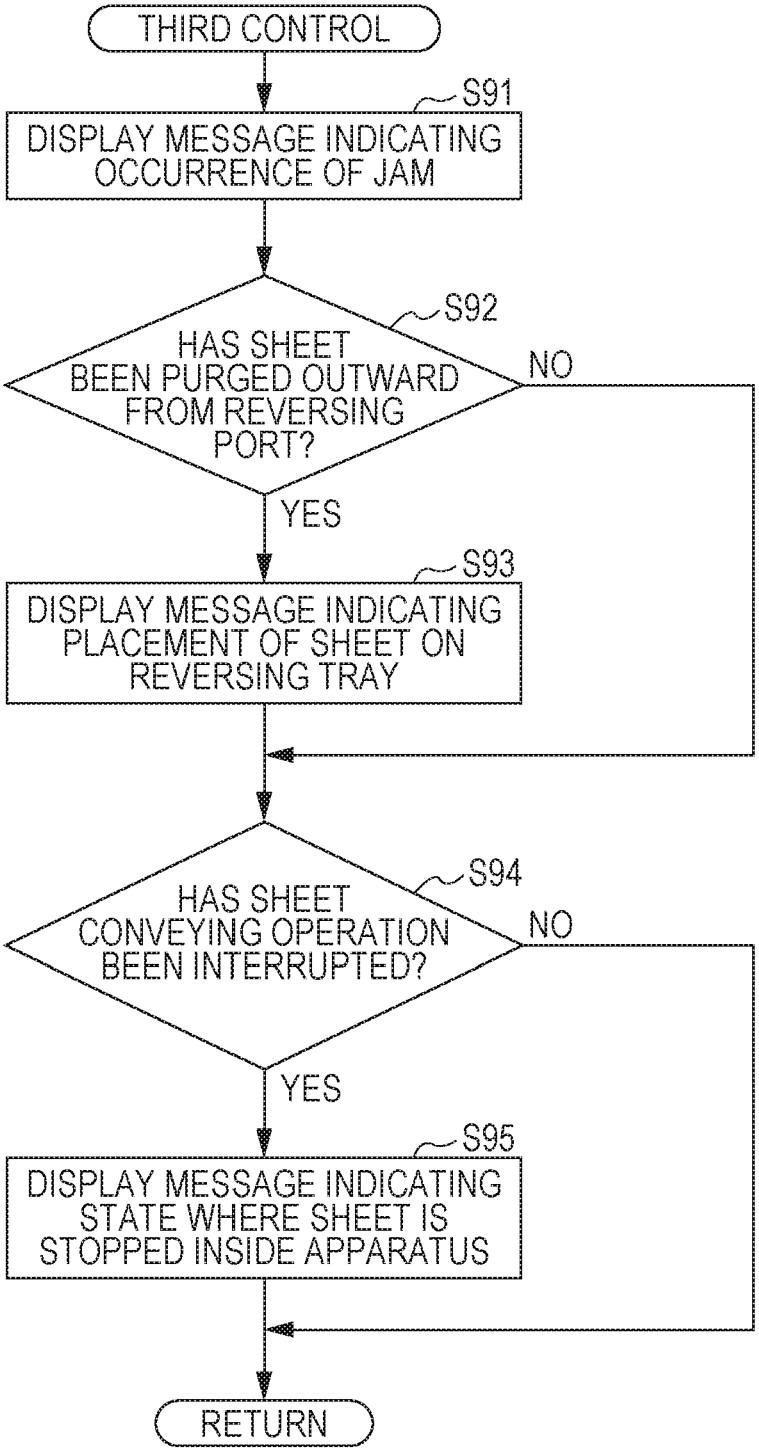
FIG. 14 is a flowchart illustrating the content of a subroutine of a third control.

FIG. 14 is a flowchart illustrating the content of the sub-routine of the third control.

As illustrated in FIG. 14, a message indicating the occurrence of the jam is displayed on the operation panel 51 (step S91).

Then, it is determined whether the sheet is purged outward from the reversing port 44 (step S92). When it is determined that the sheet is purged ("Yes" of step S92), a message indicating a state where the sheet is placed on the reversing tray 47 is displayed on the operation panel (step S93) and the routine proceeds to step S94. Meanwhile, when it is determined that the sheet is not purged from the reversing port 44 ("No" of step S92), the process of step S93 is skipped and the routine proceeds to step S94.

In step S94, it is determined whether to interrupt the sheet conveying operation. When it is determined to interrupt the sheet conveying operation ("Yes" of step S94), a message indicating a state where the sheet is stopped inside the printer 130 and the relay unit 140 is displayed on the operation panel 51 (step S95) and the routine returns. Meanwhile, when it is determined not to interrupt the sheet conveying operation ("No" of step S94), the process of step S95 is skipped and the routine returns. When there is only one message of the display target, only the message is displayed. Then, when there are two or more messages, the messages are displayed in parallel.

In addition, when any sheet is not specified as a purging target, that is, any sheet exists as a purging target at the jam detection time point in step S11, the sheet conveying operation is interrupted when there is a current conveyed sheet, the third control is performed (step S15), and the corresponding process is ended.

As described above, when there is the current conveyed sheet Sa to be reversed on the reversing path 4*b* when the jam generated in the post-processing device 150 is detected during the duplex printing job of the plurality of sheets and there is at least one current conveyed sheet Sb in the conveying path 1*a* and the circulation path 48, the sheets Sa and Sb are continuously conveyed and the original conveying order is changed. Then, a purging control is performed in which the sheet Sa is purged (discharged) outward from the reversing port 44 while not being reversed and the sheet Sb is guided to the reversing path 4*b* and is purged outward from the reversing port 44 while not being reversed.

Accordingly, since it is possible to prevent the sheets Sa and Sb from being stopped in the printer 130, a user may just remove the jammed sheet and the sheet retracted to the delivery path 4*a*. Thus, the effort of the user in the sheet removing operation is reduced.

Further, since the purging control is performed when the second condition is satisfied even when the sheet Sc reversed by the reversing roller 45 exists, it is possible to obtain an effect that the effort of the user in the sheet removing operation is reduced even at that time.

The present invention is not limited to the sheet conveying device, and the image forming apparatus and the image forming system including the sheet conveying device, and the present invention may be applied to a purging control method. Further, the method may be a program that is executed by a computer. Further, a program according to the present invention can be recorded in, for example, a magnetic disk such as a magnetic tape and a flexible disk, an optical recording medium such as a DVD-ROM, a DVD-RAM, a CD-ROM, a CD-R, a MO, and a PD, a flash memory recording medium. In this way, the program can be stored in various recording media which can be read by a computer. The program can be manufactured and distributed in the form of the corresponding recording medium or can be transmitted and supplied through various wired and wireless networks including the Internet, a broadcasting, an electric communication line, or a satellite communication.

Modified Example

While the embodiment of the present invention has been described, the present invention is not limited to the above-described embodiment and a modified example may be considered as below.

(1) In the above-described embodiment, the purging control is performed when the time relation of Tb<Ta as the second condition is satisfied in the second control (FIG. 13), but the second condition is not limited thereto.

Figure 15:
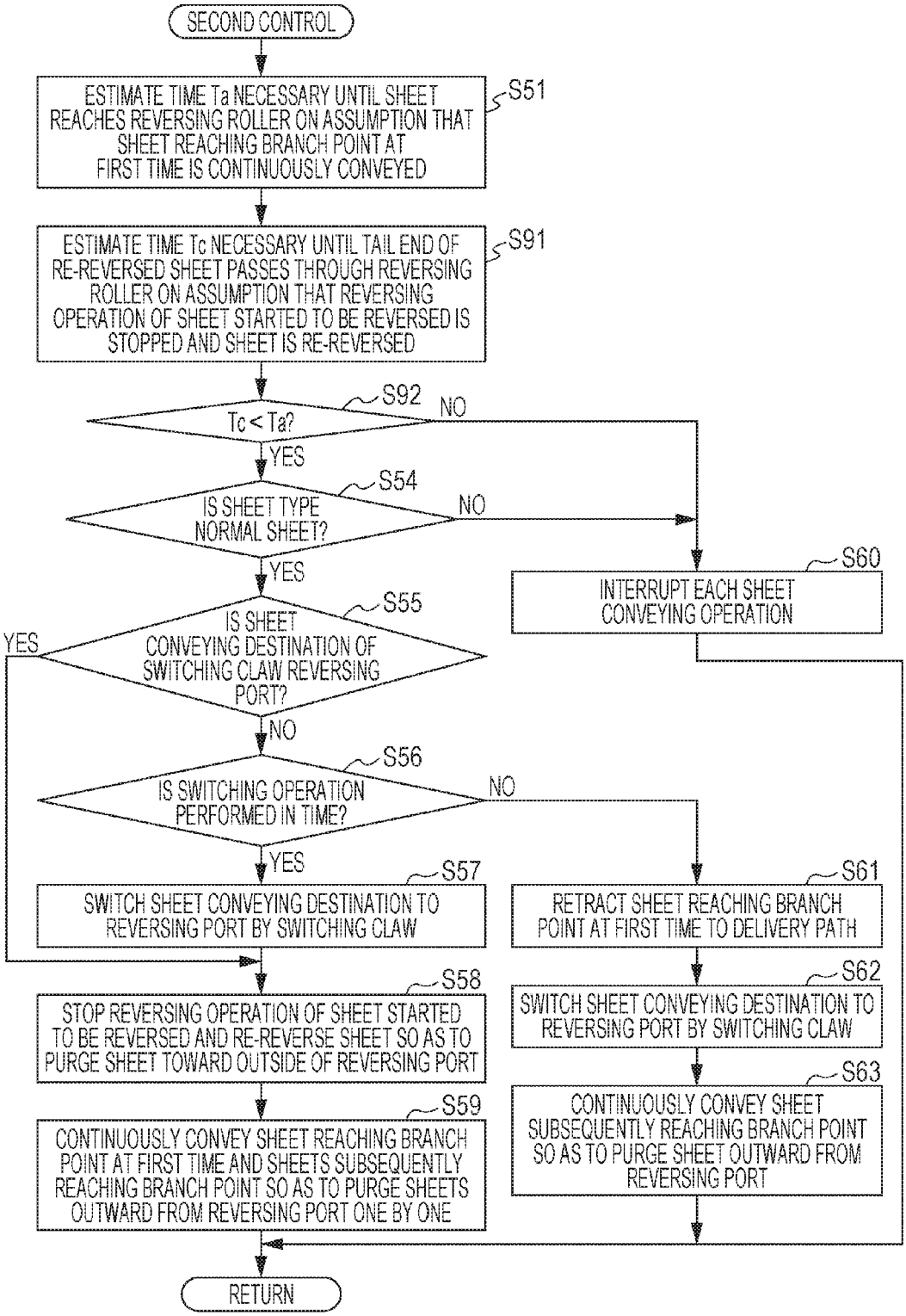
FIG. 15 is a flowchart illustrating the content of a second control according to a modified example.

FIG. 15 is a flowchart illustrating the content of a second control according to a modified example, and the same reference numerals are given to the same steps as the second control of the embodiment.

As illustrated in FIG. 15, when it is assumed that the re-reversing operation is performed by stopping the reversing operation of the reversed sheet Sc, the time Tc necessary for the tail end Se of the re-reversed sheet Sc in the discharge direction to pass through the reversing roller 45 is estimated in step S91.

The time Tc can be estimated from the following equation (Equation 1).

$$Tc=(tb1+tb2+tb3)+(Lf+Lg-Lh)/V \quad \text{(Equation 1)}$$

Here, Lf indicates a distance from the leading end (corresponding to the tail end in the discharge direction during the re-reversing operation) of the sheet Sc which is currently reversed when a re-reversing start instruction is generated for the reversing motor RM during the reversing operation (the time point tj of FIG. 9B) to the reversing roller 45.

Lg indicates a distance in which the sheet Sc advances until the reversing motor RM is decelerated and stopped after the re-reversing start instruction is generated.

Lh indicates the conveying distance of the sheet Sc advancing from the start of the re-reversing operation to the time tb3 necessary for the reversing motor RM to rise to the rotation speed Vc corresponding to the system speed V.

Then, it is determined whether the time relation of Tc<Ta is satisfied in step S92. When the time relation of Tc<Ta is satisfied, this condition indicates a state where the sheet Sb (the sheet reaching the branch point BP at the first time in step S51) supposed to be continuously conveyed on the reversing path 4*b* does not reach the reversing roller 45 yet at the time point in which the tail end of the sheet Sc assumed to be re-reversed passes through the reversing roller 45. Even in the sheet Sc which is conveyed in the discharge direction by the re-reversing operation of the reversing roller 45 and the sheet Sb which is conveyed on the reversing path 4*b* toward the reversing roller 45 in the discharge direction, the conveying speed is the same as the system speed V. Thus, when the time relation of Tc<Ta is satisfied, the leading end of the sheet Sb cannot catch up with the tail end of the sheet Sc until the tail end of the sheet Sc passes through the reversing roller 45.

Thus, the sheets Sc and Sb can be discharged from the reversing port 44 in this order so that the re-reversed sheet Sc does not contact the sheet Sb continuously conveyed on the reversing path 4*b*.

When it is determined that the time relation of Tc<Ta is satisfied ("Yes" of step S92), the routine proceeds to step S54. Meanwhile, when it is determined that the time relation is not satisfied ("No" of step S92), the routine proceeds to step S60.

As illustrated in FIG. 15, a condition in which the time relation of Tc<Ta is satisfied may be set to the second condition as the purging performing condition. Further, a control illustrated in FIG. 16 can be used when the sheet conveying speed during the re-reversing operation can be switched between two levels including a standard one and a high-speed one.

Figure 16:
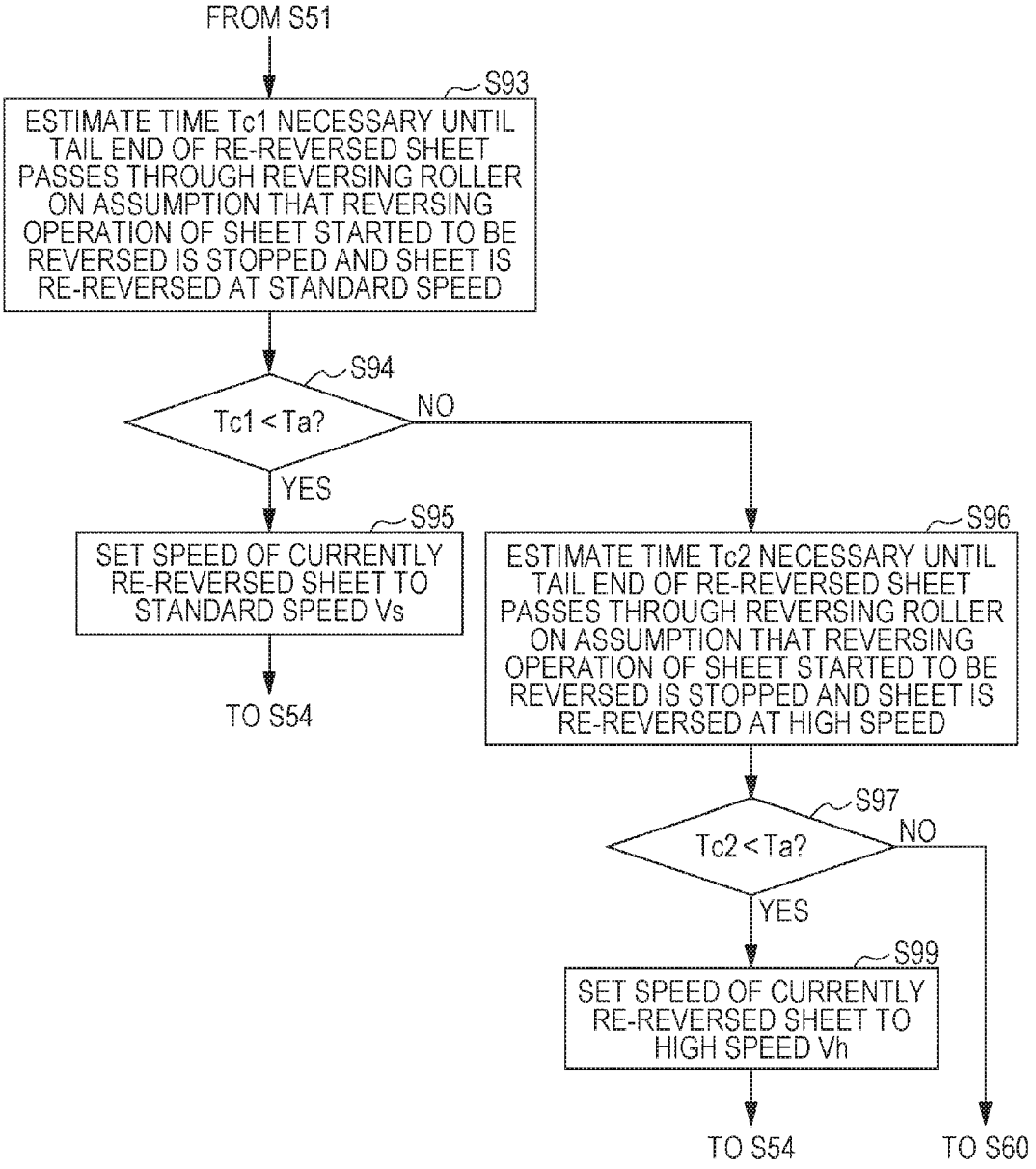
FIG. 16 is a flowchart illustrating a part of the content of another second control according to the modified example.

FIG. 16 illustrates a state where step S91 and step S92 as a part of the second control illustrated in FIG. 15 are changed to step S93 to step S98. Here, only the difference from FIG. 15 is illustrated.

In step S93, the time Tc1 is estimated on the assumption that the conveying speed of the sheet Sc during the re-reversing operation is the standard speed. The time Tc1 is estimated by using an equation in which the parameters tb3, Lh, and V of Equation 1 are changed to values corresponding to the standard speed Vs.

When it is determined that the time relation of Tc1<Ta is satisfied ("Yes" of step S94), the conveying speed of the sheet Sc during the re-reversing operation is set to the standard speed Vs (step S95), and the routine proceeds to step S54. Subsequently, when the sheet is re-reversed, the reversing motor RM is controlled so that the sheet is conveyed at the set standard speed Vs.

Meanwhile, when it is determined that the time relation of Tc1<Ta is not satisfied ("No" of step S94), the routine proceeds to step S96.

In step S96, the time Tc2 is estimated when the conveying speed of the sheet Sc during the re-reversing operation is set to the high speed Vh faster than the standard speed Vs. The estimation is performed by using an equation in which the parameters tb3, Lh, and V of Equation 1 are changed to the values corresponding to the high speed Vh.

When it is determined that the time relation of Tc2<Ta is satisfied ("Yes" of step S97), the conveying speed of the sheet Sc during the re-reversing operation is set to the high speed Vh (step S98) and the routine proceeds to step S54. Subsequently, when the sheet is re-reversed, the reversing motor RM is controlled so that the sheet is conveyed at the set high speed Vh. In addition, the sheet Sc starts to be re-reversed at the high speed Vh and the conveying speed of the reversing roller 45 is returned to the original standard speed Vs at the time point in which the leading end of the sheet Sb conveyed on the reversing path 4*b* toward the reversing roller 45 reaches the reversing roller 45.

Meanwhile, when it is determined that the time relation of Tc2<Ta is not satisfied ("No" of step S97), the routine proceeds to step S60.

In this way, when it is possible to prevent the contact between the sheets Sc and Sa when the conveying speed of the sheet Sc during the re-reversing operation is switched to the high speed Vh, a condition in which the conveying speed of the sheet Sc during the re-reversing operation is switched to the high speed Vh can be added to the second condition as the purging performing condition.

(2) Further, when the leading end of the sheet Sc which is currently reversed by the reversing roller 45 already reaches the conveying roller 48*a* (the rotating and conveying member) when the jam is detected, the purging control can be prohibited even when the second condition is satisfied.

A case where the leading end of the sheet Sc which is currently reversed reaches the conveying roller 48*a* indicates a state where the leading end of one sheet Sc is conveyed by the conveying roller 48*a* and the tail end thereof is conveyed in the reversing direction by the reversing roller 45.

In order to re-reverse the sheet Sc in this state, there is a need to provide a mechanism for allowing the reverse rotation of the conveying roller 48*a* which does not need to be rotated reversely originally and a control for reversely rotating the conveying roller 48*a* so as to be synchronized with the reversing roller 45. Accordingly, the configuration of the apparatus becomes complex.

For this reason, in the configuration of the embodiment, a driving mechanism including the motor M5 is not provided with a member, for example, a clutch that connects or disconnects a transmission path transmitting a driving force from the motor M5 to the conveying roller 48*a*. Here, when the jam is detected, the motor M5 is stopped and the transmission of the driving force to the conveying roller 48*a* is stopped. Thus, when the stopped conveying roller 48*a* is rotated reversely, the conveying roller 48*a* serves as a rotation load which is added to the motor M5 in the transmission route of the driving mechanism.

Meanwhile, the reversing roller 45 cannot be switched to the normal rotation state for the re-reversing operation while the conveying roller 48*a* is rotated normally. In a state where a forward conveying force is applied to the leading end of the sheet Sc in the traveling direction of the conveying roller 48*a*, a conveying force generated in a direction (the discharge direction) opposite to the traveling direction of the reversing roller 45 is applied to the tail end and the sheet Sc is drawn. As a result, a large burden is applied to the driving mechanisms of the rollers at both sides of the sheet Sc.

Here, when the leading end of the sheet Sa currently reversed at the jam detection time point already passes through the conveying roller 48*a*, a control of prohibiting the re-reversing operation of the sheet Sc can be performed. In this case, the sheet Sc can directly advance on the circulation path 48 so as to be returned to the conveying path 1*a* and can be purged outward from the reversing port 44 through the conveying path 1*a* and the reversing path 4*b*. Accordingly, it is possible to prevent a drawing force from being applied to the sheet Sc while the configuration of the apparatus is not changed and hence to prevent a burden from being applied to the driving mechanism for the reversing roller 45 and the conveying roller 48*a*.

Figure 17:
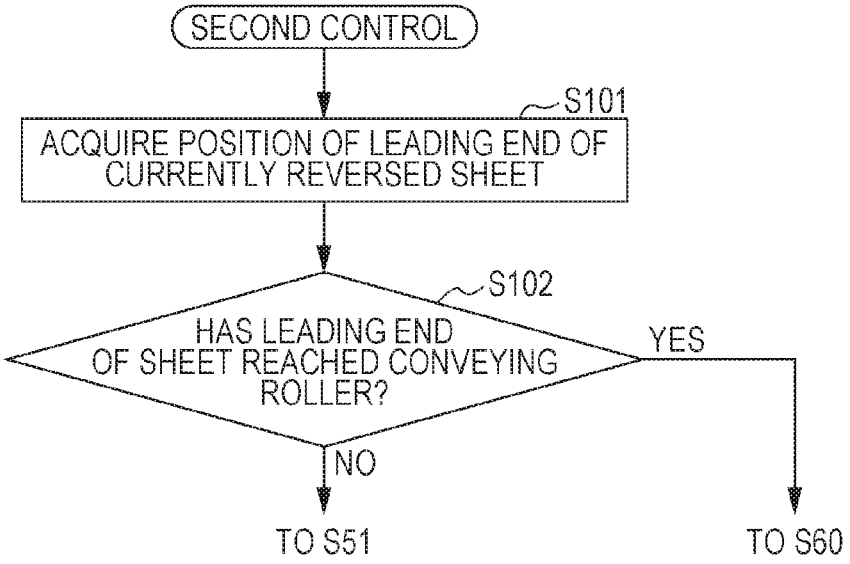
FIG. 17 is a flowchart illustrating a part of the content of a second control including a sheet re-reversing operation prohibiting process according to the modified example.

FIG. 17 is a flowchart illustrating the content of a second control including a sheet re-reversing operation prohibiting process according to the modified example. Here, the processes of step S101 and step S102 are performed before step S51 of the second control illustrated in FIG. 15, and the points other than step S101 and step S102 are omitted.

As illustrated in FIG. 17, the current position of the leading end of the sheet Sc which is currently reversed is acquired (step S101). Then, it is determined whether the leading end of the sheet Sc reaches the conveying roller 48*a* (step S102). The determination is made by determining whether the current position of the leading end of the sheet Sc is located at the downstream side of the arrangement position of the conveying roller 48*a* in the conveying direction after acquiring the current position of the leading end of the sheet Sc and the arrangement position of the conveying roller 48*a* on the circulation path 48.

When it is determined that the leading end of the sheet Sc does not reach the conveying roller 48*a* ("No" of step S102), the routine proceeds to step S51. In this case, when the purging performing condition is satisfied, the purging control is performed.

Meanwhile, when it is determined that the leading end of the sheet Sc reaches the conveying roller 48*a* ("Yes" of step S102), the routine proceeds to step S60. In this case, the purging control is not performed (is prohibited) regardless of whether the purging performing condition is satisfied.

(3) Further, for example, when a mechanism that connects or disconnects a driving force transmission route from the motor M5 toward the conveying roller 48*a* is employed instead of the above-described configuration, the purging control cannot be performed even when the leading end of the sheet Sc which is currently reversed reaches the conveying roller 48*a* at the jam detection time point.

Specifically, a configuration is supposed in which a clutch is used as a member that connects or disconnects the transmission route. In this configuration, the conveying roller 48*a* is separated from the driving mechanism in a manner such that the clutch is disconnected so as to disconnect the transmission route at the jam detection time point. Accordingly, when the conveying roller 48*a* is freely rotatable in the normal and reverse rotation directions, the conveying roller 48*a* is reversely rotated (driven) along the re-reversed sheet Sc in the purging control. For this reason, when the sheet Sc which is currently reversed is re-reversed, the purging control can be performed while no load is applied to the driving mechanism of the conveying roller 48*a*.

When this configuration is employed, a driving load is applied to the conveying roller 48*a* as well as the reversing roller 28 during the re-reversing operation of the sheet Sc in the reversing motor RM, and hence the burden on the reversing motor RM increases. Generally, when a sheet is conveyed while being nipped by a pair of rollers, the load generated when rotating the roller is large in the thick sheet rather than the thin sheet. The thick sheet can be a sheet of which the basis weight is larger than a predetermined value, for example, 100 g/m$^2$.

The same applies to the reversing roller 28 or the conveying roller 48*a*. That is, since the rotation load of each roller is large in the thick sheet rather than the thin sheet in the case of the sheet Sc which is currently reversed, the burden of the reversing motor RM also increases. Here, a configuration may be employed which determines whether to perform the purging operation on the thick sheet and the sheet other than the thick sheet in response to the type of sheet.

Figure 18:
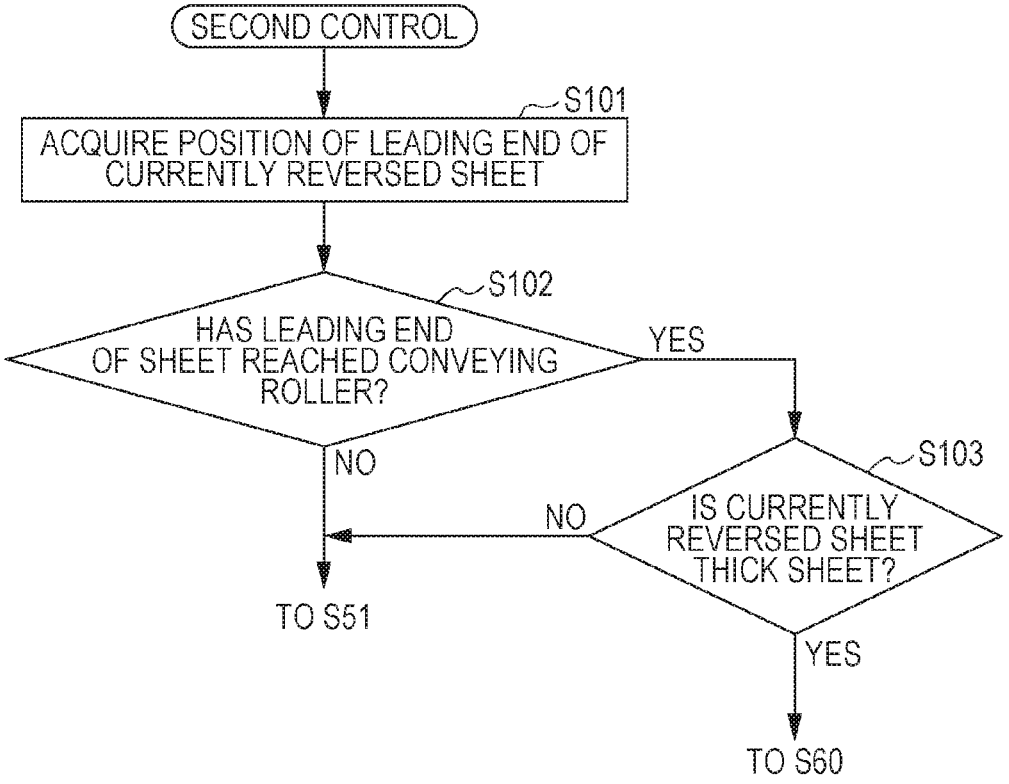
FIG. 18 is a flowchart illustrating a part of the content including a sheet re-reversing operation determining process in response to the type of sheet in the second control according to the modified example.

FIG. 18 is a flowchart illustrating a part of the content including a sheet re-reversing operation determining process in response to the type of sheet in the second control according to the modified example. Here, this flowchart has a difference in that step S103 is added after step S102 illustrated in FIG. 17.

That is, when the leading end of the sheet Sc which is currently reversed reaches the conveying roller 48*a* ("Yes" of step S102), the routine proceeds to step S51 if the sheet Sc which is currently reversed is not the thick sheet ("No" of step S103), and the purging control is not prohibited. Meanwhile, if the sheet Sc which is currently reversed is the thick sheet ("Yes" of step S103), the routine proceeds to step S60 and the purging control is prohibited. Accordingly, it is possible to reduce the burden of the reversing motor RM during the re-reversing operation of the sheet Sc.

Further, the determination on whether the sheet Sc which is currently reversed is the thick sheet can be performed in a manner such that the type of sheet received in the hand insertion tray 16 is registered from the operation panel 51 in advance by the user, for example, when the thick sheet is received in the hand insertion tray 16. Further, when a mechanism for automatically detecting the type of conveyed sheet, for example, the normal sheet, the thick sheet, and the thin sheet by a sensor is employed, the detection result of the sensor can be used for the determination.

Further, for example, when the type of sheet is any one of a high-quality sheet, a glossy sheet, a coated sheet, and a color sheet instead of the thick sheet, the purging control may be prohibited. When the sheet is re-reversed, there is a case in which a trace of the roller of a stripe shape remains on a contact portion on the sheet with respect to the reversing roller 28 or the conveying roller 48*a* in accordance with the type of sheet when the sheet is switched from the reversing operation to the re-reversing operation. Since the high-quality sheet or the like is generally more expensive than the normal sheet, the damage of the sheet can be prevented by prohibiting the purging operation.

(4) Further, the sheet re-reversing operation determining process can be performed depending on whether the leading end of the sheet Sc which is currently reversed reaches any roller of the conveying rollers 48*a* to 48*d* at the jam detection time point instead of the sheet re-reversing operation determining process in response to the type of sheet.

Specifically, the purging operation is prohibited when the leading end of the sheet Sc which is currently reversed reaches the conveying roller 48*b* while passing by the conveying roller 48*a* at the jam detection time point. Meanwhile, the purging operation is allowed when the leading end of the sheet does not reach the conveying roller 48*b* although the leading end thereof passes by the conveying roller 48*a*.

When the sheet Sc which is currently reversed is of a large size long in the conveying direction, the sheet may be conveyed while straddling three rollers including the reversing roller 45 and the conveying rollers 48*a* and 48*b*. If the re-reversing operation is performed by stopping the reversing operation in this state, the rotation load of the conveying rollers 48*a* and 48*b* is added to the reversing motor RM as well as the rotation load of the reversing roller 45. As a result, the burden of the reversing motor RM increases.

Meanwhile, when the leading end of the sheet Sc which is currently reversed does not reach the conveying roller 48*b* although the leading end thereof passes by the conveying roller 48*a*, the load applied to the reversing motor RM during the re-reversing operation corresponds to only two rollers including the reversing roller 45 and the conveying roller 48*a*. Thus, the burden of the reversing motor RM is reduced compared with the case of three rollers.

Then, if the conveying speed of the sheet Sc is the same as the system speed in any one of the case where the sheet Sc which is currently reversed is purged outward from the reversing port 44 by the re-reversing operation and the case where the sheet is returned to the conveying path 1*a* through the circulation path 48, is guided to the reversing path 4*b*, and is purged outward from the reversing port 44, the total conveying distance necessary for the conveying operation until the purging operation is short in the case of the re-reversing operation. Accordingly, the time necessary for the purging operation is short in the case of the purging operation by the re-reversing operation.

A user can start the jam removing operation early when the purging operation is completed as early as possible. In other words, the standby time necessary for the completion of the purging operation is conveniently short.

Here, since the purging operation is allowed when the leading end of the sheet Sc which is currently reversed does not reach the conveying roller 48*b* (the second rotating and conveying member) although the leading end passes by the conveying roller 48*a* (the first rotating and conveying member) at the jam detection time point, the operability of the user can be improved although a certain degree of a burden is applied to the reversing motor RM.

Figure 19:
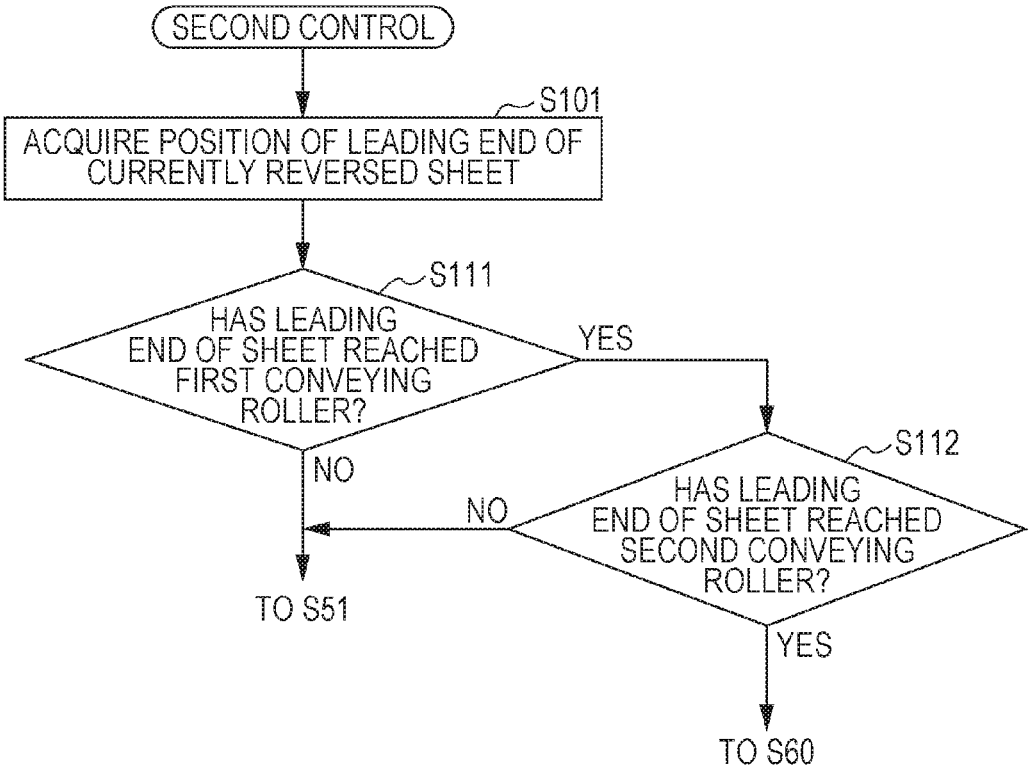
FIG. 19 is a flowchart illustrating a part of the content including a sheet re-reversing operation determining process in response to a sheet leading end advancing state for a sheet being reversed at a jam detection time point in the second control according to the modified example.

FIG. 19 is a flowchart illustrating a part of the content including the sheet re-reversing operation determining process in response to the leading end advancing state of the sheet Sc which is currently reversed at the jam detection time point in the second control according to the modified example. There is a difference in that the processes of step S111 and step S112 are performed instead of step S102 of the second control illustrated in FIG. 17.

That is, when it is determined that the leading end of the sheet Sc which is currently reversed does not reach the second conveying roller 48*b* ("No" of step S112) although the leading end passes by the first conveying roller 48*a* ("Yes" of step S111) at the jam detection time point, the routine proceeds to step S51. Meanwhile, when it is determined that the leading end reaches the second conveying roller 48*a* ("Yes" of step S112), the routine proceeds to step S60.

Further, in the description above, the routine proceeds to step S51 when the leading end of the sheet Sc which is currently reversed does not advance to the second conveying roller 48*b* at the jam detection time point, but the present invention is not limited thereto.

For example, in a configuration in which a plurality of conveying rollers is disposed in the circulation path 48 with a short gap interposed therebetween, the routine may proceed to step S60 when the leading end of the sheet Sc which is currently reversed does not advance to the third roller at the jam detection time point. A control in which the routine proceeds to step S51 when the leading end of the sheet advances to the roller located at a certain position on the downstream side from the most upstream roller in response to the allowable range of the load applied to the reversing motor RM can be determined in advance by an experiment or the like.

Further, in the description above, a user inputs the type of sheet (the normal sheet or the like) from the operation panel 51, but the present invention is not limited thereto. For example, a configuration of detecting the type of sheet by a sensor or the like can be used. Further, as the type of sheet, a letterhead sheet or an OHP sheet also exists in addition to the above-described examples. Whether the purging control is allowed or prohibited in accordance with the type of sheet can be determined in advance.

(6) In the above-described embodiment, an example has been described in which the image forming apparatus including the sheet conveying device according to the present invention is applied to the tandem type printer 130, but the present invention is not limited to the tandem type printer. Further, the present invention can be generally applied to an image forming apparatus, for example, a copying machine and a facsimile device having a duplex image forming function of forming an image such as a toner image on both surfaces (the first surface and the second surface) of the sheet regardless of the color and monochrome image forming function. Further, the present invention is not limited to the electro photographic type image forming apparatus. For example, the present invention can be also applied to an inkjet type image forming apparatus. In addition, the present invention is not limited to the image forming apparatus and can be generally applied to a sheet conveying device that conveys a sheet to a device at a sheet conveying destination.

Further, the post-process of the post-processing device 150 may include a process of sorting the sheet, a process of binding and punching the sheet, a process of folding the sheet into two parts, or a process of inserting another sheet into the sheet bundle other than the process of evenly arranging the sheet bundle and the process of stapling the sheet bundle.

Further, in the description above, a configuration example has been described in which the purging control is performed in the printer 130 when the jam JM occurs in the post-processing device 150, but the purging control can be performed when the jam JM occurs in the device at the sheet conveying destination to which the sheet is discharged from the printer 130. Since the device at the sheet conveying destination also includes the relay unit 140, the purging control can be performed in the printer 130 when the jam JM occurs in any one of the post-processing device 150 and the relay unit 140.

Further, the configurations of the above-described embodiments and the above-described modified examples may be combined with one another.

The present invention can be widely applied to the sheet conveying device that conveys the sheet.

According to an embodiment of the present invention, the first sheet which is not reversed yet is continuously conveyed and is discharged from the reversing port. Thus, even when the subsequent second sheet is guided to the reversing port, a new jam does not occur due to the collision between the first sheet which is currently reversed and the second sheet which is subsequently conveyed to the reversing port. Accordingly, it is possible to purge the first and second sheets from the reversing port without causing a new jam. As a result, it is possible to reduce the effort of the user in the sheet removing operation at the jam detection time point.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A sheet conveying device configured to convey a sheet toward a device at a sheet conveying destination in a normal operation state and to interrupt the sheet conveying operation toward the device at the sheet conveying destination when a jam is detected, the sheet conveying device comprising:

a conveying unit configured to convey a sheet along a conveying path;

a switching unit configured to switch a sheet conveying destination from a branch point as a downstream end of the conveying path to any one of a delivery path extending toward the device at the sheet conveying destination and a reversing port formed as an opening of a casing of the sheet conveying device so that a space outside the casing is used as a space for reversing a sheet conveying direction;

a delivering unit configured to deliver the sheet on the delivery path toward the device at the sheet conveying destination;

a reversing unit configured to first convey the sheet from the reversing port toward the outside of the casing to a position in which a part of the sheet protrudes and deliver the sheet from the position toward a circulation path while reversing the conveying direction of the sheet;

a circulating unit configured to convey the sheet delivered toward the circulation path along the circulation path and return the sheet to the conveying path while the sheet is reversed; and a control unit configured to determine whether or not a jammed sheet is detected in the device at the sheet conveying destination, and when it is determined that the jammed sheet is detected, to control the reversing unit so that a first sheet, which is supposed to be reversed by the reversing unit, is not reversed and is purged from the reversing port toward the outside of the casing before stopping driving of the reversing unit to allow the jammed sheet to be removed, wherein the control unit stops each sheet conveying operation by prohibiting the purging operation when the first sheet is a specific type of sheet.

2. The sheet conveying device according to claim 1, wherein when there is a second sheet conveyed in any one of the conveying unit and the circulating unit separately from the first sheet at a jam detection time point, the control unit controls the conveying unit, the reversing unit, the circulating unit, and the switching unit so that the sheet conveying destination of the second sheet is switched to the reversing port and the second sheet is purged from the reversing port toward the outside of the casing while not reversing the second sheet after the first sheet is purged.

3. The sheet conveying device according to claim 1, wherein if a predetermined condition is satisfied when the first sheet does not exist and a second sheet currently reversed by the reversing unit exists at a jam detection time point, the control unit stops the reversing operation of the second sheet and re-reverses the second sheet in a direction toward the reversing port so that the second sheet is purged from the reversing port toward the outside of the casing.

4. The sheet conveying device according to claim 3, wherein when there is a third sheet conveyed in at least one of the conveying unit and the circulating unit separately from the second sheet at the jam detection time point, the control unit controls the conveying unit, the reversing unit, the circulating unit, and the switching unit so that the sheet conveying destination of the third sheet is switched to the reversing port and the third sheet is purged from the reversing port toward the outside of the casing while not reversing the third sheet after the second sheet is purged.

5. The sheet conveying device according to claim 3, wherein a conveying speed of the second sheet during the re-reversing operation is faster than a conveying speed of the second sheet during the reversing operation of the reversing unit.

6. The sheet conveying device according to claim 3, wherein:

the circulating unit includes a pair of rotating and conveying members conveying the sheet along the circulation path while nipping the sheet during the reversing operation, the reversing unit and the pair of rotating and conveying members are driven by different driving mechanisms, and when a leading end of the second sheet in the sheet conveying direction during the reversing operation reaches the pair of rotating and conveying members at the jam detection time point, the control unit stops each sheet conveying operation by prohibiting the purging operation regardless of whether the predetermined condition is satisfied.

7. The sheet conveying device according to claim 6, wherein the driving mechanism of the rotating and conveying member is not provided with a member stopping transmission of a driving force to the pair of rotating and conveying members at the jam detection time point so as to connect or disconnect a transmission route transmitting the driving force to the rotating and conveying member.

8. The sheet conveying device according to claim 1, wherein the specific type of sheet is a thin sheet having a basis weight smaller than a predetermined value.

9. An image forming apparatus configured to form an image on a sheet conveyed by a sheet conveying part, the image forming apparatus comprising the sheet conveying device according to claim 1 as the sheet conveying part.

10. An image forming system comprising:

the image forming apparatus according to claim 9; and a post-processing device configured to perform predetermined post-processing on a sheet having an image formed thereon by the image forming apparatus, wherein a device at a sheet conveying destination of the sheet conveying device of the image forming apparatus is the post-processing device.

11. A sheet conveying device configured to convey a sheet toward a device at a sheet conveying destination in a normal operation state and to interrupt the sheet conveying operation toward the device at the sheet conveying destination when a jam is detected, the sheet conveying device comprising:

a conveying unit configured to convey a sheet along a conveying path;

a switching unit configured to switch a sheet conveying destination from a branch point as a downstream end of the conveying path to any one of a delivery path extending toward the device at the sheet conveying destination and a reversing port formed as an opening of a casing of the sheet conveying device so that a space outside the casing is used as a space for reversing a sheet conveying direction;

a delivering unit configured to deliver the sheet on the delivery path toward the device at the sheet conveying destination;

a reversing unit configured to first convey the sheet from the reversing port toward the outside of the casing to a position in which a part of the sheet protrudes and deliver the sheet from the position toward a circulation path while reversing the conveying direction of the sheet;

a circulating unit configured to convey the sheet delivered toward the circulation path along the circulation path and return the sheet to the conveying path while the sheet is reversed; and a control unit configured to determine whether or not a jammed sheet is detected in the device at the sheet conveying destination, and when it is determined that the jammed sheet is detected, to control the reversing unit so that a first sheet, which is supposed to be reversed by the reversing unit, is not reversed and is purged from the reversing port toward the outside of the casing before stopping driving of the reversing unit to allow the jammed sheet to be removed, wherein if a predetermined condition is satisfied when the first sheet does not exist and a second sheet currently reversed by the reversing unit exists at a jam detection time point, the control unit stops the reversing operation of the second sheet and re-reverses the second sheet in a direction toward the reversing port so that the second sheet is purged from the reversing port toward the outside of the casing, wherein when there is a third sheet conveyed in at least one of the conveying unit and the circulating unit separately from the second sheet at the jam detection time point, the control unit controls the conveying unit, the reversing unit, the circulating unit, and the switching unit so that the sheet conveying destination of the third sheet is switched to the reversing port and the third sheet is purged from the reversing port toward the outside of the casing while not reversing the third sheet after the second sheet is purged, and wherein on the assumption that the second sheet is re-reversed while the third sheet reaching the branch point for a first time is continuously conveyed after the jam detection time point, the predetermined condition is a condition in which a leading end of the third sheet in the sheet conveying direction reaches the reversing unit after the reversing operation of the second sheet is completely switched to the re-reversing operation thereof.

12. A sheet conveying device configured to convey a sheet toward a device at a sheet conveying destination in a normal operation state and to interrupt the sheet conveying operation toward the device at the sheet conveying destination when a jam is detected, the sheet conveying device comprising:

a conveying unit configured to convey a sheet along a conveying path;

a switching unit configured to switch a sheet conveying destination from a branch point as a downstream end of the conveying path to any one of a delivery path extending toward the device at the sheet conveying destination and a reversing port formed as an opening of a casing of the sheet conveying device so that a space outside the casing is used as a space for reversing a sheet conveying direction;

a delivering unit configured to deliver the sheet on the delivery path toward the device at the sheet conveying destination;

a reversing unit configured to first convey the sheet from the reversing port toward the outside of the casing to a position in which a part of the sheet protrudes and deliver the sheet from the position toward a circulation path while reversing the conveying direction of the sheet;

a circulating unit configured to convey the sheet delivered toward the circulation path along the circulation path and return the sheet to the conveying path while the sheet is reversed; and a control unit configured to determine whether or not a jammed sheet is detected in the device at the sheet conveying destination, and when it is determined that the jammed sheet is detected, to control the reversing unit so that a first sheet, which is supposed to be reversed by the reversing unit, is not reversed and is purged from the reversing port toward the outside of the casing before stopping driving of the reversing unit to allow the jammed sheet to be removed, wherein if a predetermined condition is satisfied when the first sheet does not exist and a second sheet currently reversed by the reversing unit exists at a jam detection time point, the control unit stops the reversing operation of the second sheet and re-reverses the second sheet in a direction toward the reversing port so that the second sheet is purged from the reversing port toward the outside of the casing, wherein when there is a third sheet conveyed in at least one of the conveying unit and the circulating unit separately from the second sheet at the jam detection time point, the control unit controls the conveying unit, the reversing unit, the circulating unit, and the switching unit so that the sheet conveying destination of the third sheet is switched to the reversing port and the third sheet is purged from the reversing port toward the outside of the casing while not reversing the third sheet after the second sheet is purged, and wherein on the assumption that the second sheet is re-reversed while the third sheet reaching the branch point for a first time is continuously conveyed after the jam detection time point, the predetermined condition is a condition in which the third sheet does not contact the second sheet.

13. A sheet conveying device configured to convey a sheet toward a device at a sheet conveying destination in a normal operation state and to interrupt the sheet conveying operation toward the device at the sheet conveying destination when a jam is detected, the sheet conveying device comprising:

a conveying unit configured to convey a sheet along a conveying path;

a switching unit configured to switch a sheet conveying destination from a branch point as a downstream end of the conveying path to any one of a delivery path extending toward the device at the sheet conveying destination and a reversing port formed as an opening of a casing of the sheet conveying device so that a space outside the casing is used as a space for reversing a sheet conveying direction;

a delivering unit configured to deliver the sheet on the delivery path toward the device at the sheet conveying destination;

a reversing unit configured to first convey the sheet from the reversing port toward the outside of the casing to a position in which a part of the sheet protrudes and deliver the sheet from the position toward a circulation path while reversing the conveying direction of the sheet;

a circulating unit configured to convey the sheet delivered toward the circulation path along the circulation path and return the sheet to the conveying path while the sheet is reversed; and a control unit configured to determine whether or not a jammed sheet is detected in the device at the sheet conveying destination, and when it is determined that the jammed sheet is detected, to control the reversing unit so that a first sheet, which is supposed to be reversed by the reversing unit, is not reversed and is purged from the reversing port toward the outside of the casing before stopping driving of the reversing unit to allow the jammed sheet to be removed, wherein:

wherein if a predetermined condition is satisfied when the first sheet does not exist and a second sheet currently reversed by the reversing unit exists at a jam detection time point, the control unit stops the reversing operation of the second sheet and re-reverses the second sheet in a direction toward the reversing port so that the second sheet is purged from the reversing port toward the outside of the casing, the circulating unit includes a pair of rotating and conveying members conveying the sheet along the circulation path while nipping the sheet during the reversing operation, the reversing unit and the pair of rotating and conveying members are driven by different driving mechanisms, the driving mechanism of the pair of rotating and conveying members is provided with a member stopping transmission of a driving force to the pair of rotating and conveying members at the jam detection time point so as to connect or disconnect a transmission route transmitting the driving force to the pair of rotating and conveying members, and if the predetermined condition is satisfied even when a leading end of the second sheet in the sheet conveying direction during the reversing operation reaches the pair of rotating and conveying members at the jam detection time point, the control unit disconnects the transmission route and purges the second sheet.

14. The sheet conveying device according to claim 13, wherein:

the circulating unit includes a plurality of the pairs of rotating and conveying members provided in the circulation path with a gap therebetween, and on the assumption that the pair of rotating and conveying members closest to the sheet conveying direction of the sheet reversed from the reversing unit among the plurality of the pairs of rotating and conveying members is set as a first pair of rotating and conveying members and the pair of rotating and conveying members secondly closest to the sheet conveying direction of the reversed sheet is set as a second pair of rotating and conveying members, the control unit purges the second sheet if the predetermined condition is satisfied when the leading end of the second sheet in the sheet conveying direction reaches the first pair of rotating and conveying members and does not reach the second pair of rotating and conveying members and the control unit stops each sheet conveying operation by prohibiting the purging operation even if the predetermined condition is satisfied when the leading end of the second sheet in the sheet conveying direction reaches the second pair of rotating and conveying members.

15. The sheet conveying device according to claim 13, wherein the control unit stops each sheet conveying operation by prohibiting the purging operation regardless of whether the predetermined condition is satisfied when the second sheet is a predetermined type of sheet.

16. The sheet conveying device according to claim 15, wherein the predetermined type of sheet is a thick sheet having a basis weight larger than a predetermined value or any one of a high-quality sheet, a glossy sheet, a coated sheet, and a color sheet.

17. A sheet conveying device configured to convey a sheet toward a device at a sheet conveying destination in a normal operation state and to interrupt the sheet conveying operation toward the device at the sheet conveying destination when a jam is detected, the sheet conveying device comprising:

a conveying unit configured to convey a sheet along a conveying path;

a switching unit configured to switch a sheet conveying destination from a branch point as a downstream end of the conveying path to any one of a delivery path extending toward the device at the sheet conveying destination and a reversing port formed as an opening of a casing of the sheet conveying device so that a space outside the casing is used as a space for reversing a sheet conveying direction;

a delivering unit configured to deliver the sheet on the delivery path toward the device at the sheet conveying destination;

a reversing unit configured to first convey the sheet from the reversing port toward the outside of the casing to a position in which a part of the sheet protrudes and deliver the sheet from the position toward a circulation path while reversing the conveying direction of the sheet;

a circulating unit configured to convey the sheet delivered toward the circulation path along the circulation path and return the sheet to the conveying path while the sheet is reversed; and a control unit configured to determine whether or not a jammed sheet is detected in the device at the sheet conveying destination, and when it is determined that the jammed sheet is detected, to control the reversing unit so that a first sheet, which is supposed to be reversed by the reversing unit, is not reversed and is purged from the reversing port toward the outside of the casing before stopping driving of the reversing unit to allow the jammed sheet to be removed, wherein:

when there is a second sheet conveyed in any one of the conveying unit and the circulating unit separately from the first sheet at a jam detection time point, the control unit controls the conveying unit, the reversing unit, the circulating unit, and the switching unit so that the sheet conveying destination of the second sheet is switched to the reversing port and the second sheet is purged from the reversing port toward the outside of the casing while not reversing the second sheet after the first sheet is purged, if a condition is not satisfied in which a leading end of the second sheet in the sheet conveying direction reaches the branch point before the switching unit completely switches the sheet conveying destination from the delivery path to the reversing port on the assumption that the second sheet reaching the branch point for a first time is continuously conveyed, the control unit prohibits the purging operation of the second sheet and retracts the second sheet to the delivery path while setting the sheet conveying destination as the delivery path, and if the second sheet reaches the branch point for a second time after having reached the branch point for the first time, the control unit causes the switching unit to switch the sheet conveying destination from the delivery path to the reversing port and purges the second sheet.

* * * * *